US006036585A

United States Patent [19]

Nishi et al.

[11] Patent Number: 6,036,585

[45] Date of Patent: Mar. 14, 2000

[54] GRINDER AND GRINDING METHOD

[75] Inventors: Kenichiro Nishi, Kanagawa; Mitsuru Nukui, Toyama; Kazuo Nakajima, Toyama; Shirou Murai, Toyama; Toyotaka Wada, Toyama, all of Japan

[73] Assignee: Nippei Toyama Corporation, Tokyo, Japan

[21] Appl. No.: 09/048,273

[22] Filed: Mar. 26, 1998

[30] Foreign Application Priority Data

Mar. 31, 1997 [JP] Japan ..... 9-081368
Oct. 31, 1997 [JP] Japan ..... 9-300861

[51] Int. Cl.[7] ..... B24B 7/17

[52] U.S. Cl. ..... 451/259; 14/262; 14/267; 14/363

[58] Field of Search ..... 451/262, 267, 451/268, 269, 259, 360, 10, 11, 14, 159, 160, 179, 363; 384/100, 107

[56] References Cited

U.S. PATENT DOCUMENTS

| | | | |
|---|---|---|---|
| 2,709,321 | 5/1955 | Indge | 451/269 |
| 3,173,230 | 3/1965 | Bovensiepen | 451/9 |
| 3,541,734 | 11/1970 | Clar | 451/269 |
| 3,805,456 | 4/1974 | Williams | 451/259 |
| 3,848,365 | 11/1974 | Bovensiepen et al. | 451/28 |
| 3,916,573 | 11/1975 | Elbe | 451/7 |
| 4,730,420 | 3/1988 | Stratmann et al. | 451/41 |
| 5,016,399 | 5/1991 | Vinson | 451/269 |
| 5,109,631 | 5/1992 | Biebesheimer et al. | 451/262 |
| 5,516,328 | 5/1996 | Kawada | 451/259 |
| 5,558,560 | 9/1996 | Uchida | 451/24 |
| 5,641,321 | 6/1997 | Suzuki | 451/45 |
| 5,833,522 | 11/1998 | Niino et al. | 451/363 X |

FOREIGN PATENT DOCUMENTS

| | | |
|---|---|---|
| 64-8282 | 1/1989 | Japan . |
| 61-270043 | 11/1996 | Japan . |

*Primary Examiner*—Timothy V. Eley
*Attorney, Agent, or Firm*—Sughrue, Mion, Zinn, Macpeak & Seas, PLLC

[57] ABSTRACT

A spindle 23 of a grinding wheel 28 is rotatively borne by a bench 22 for the grinding wheel through hydrostatic thrust bearings 26 and 27. A pressure regulator 38 for regulating the pressure which must be supplied to at least either of supply ports 26*a* and 27*a* opposite to each other in the direction of the axial line of the spindle 23 in the hydrostatic thrust bearings 26 and 27 is provided. The pressure regulator 38 has a changing member for changing a passage for choking the fluid and the length of the choking passage.

26 Claims, 12 Drawing Sheets

GRINDER AND GRINDING METHOD

BACKGROUND OF THE INVENTION

The present invention relates to a grinder and a grinding method for significantly precisely grinding at least one sides of a hard and thin work, for example a wafer utilized for a semiconductor device.

In general, a conventional grinder has spindles rotatively supported by spindle heads thereof in such a manner that a grinding wheel is secured to the leading end of each spindle. Moreover, a feeding unit comprising a motor and a ball screw is connected to the spindle head. When the spindle heads are fed and moved in the axial direction by the feeding units while the grinding wheels are rotated by the rotating motors, the outer surfaces of the work are ground.

The conventional grinder has the structure that each unit for feeding the grinding wheel comprises the motor and the ball screw. When the ball screw is rotated by the motor, the operation for feeding the spindle head is performed. However, the grinding wheels cannot precisely be fed because of insufficient rigidity of the machine and frictional resistance of sliding portions when the feeding operation must precisely be performed in order of microns or sub-microns. Thus, there arises a problem in that a precise grinding operation cannot be performed.

As a grinder capable of grinding both side surfaces of the work, Japanese Utility-Model Examined Publication No. Hei. 1-8282 teaches a conventional twin-head grinder, for example. The grinder disclosed therein has a structure that a C-shape column frame allowed to project over the frame of the grinder by a cantilever method forms a grinding head for supporting the upper grinding wheel. A bending moment acts on the column by a reaction of the grinding operation which acts on the grinding wheel because of a grinding resistance generated during the machining operation. Moreover, a thermal displacement takes place, causing a precise grinding operation to be inhibited. Therefore, a frame having an upper bed disposed above a lower bed has been disclosed. Moreover, the upper and lower grinding wheels provided for the foregoing frame are mounted to upper and lower spindles. The spindles are rotated by motors and belts disposed on the sides of the spindles. The upper spindle is vertically moved by a feeding means comprising a rack which is operated by hydraulic pressure or air pressure.

As a means for vertically moving the upper grinding wheel, a structure has been disclosed in, for example, Japanese Patent Unexamined Publication No. Sho. 61-270043. The means comprises a feeding means for vertically moving spindle heads by motors, ball screws and nuts provided for the spindle heads. The main spindle is, in the spindle head, supported by a hydrostatic bearing. Moreover, each grinding wheel is rotated by a built-in type motor.

The conventional grinder as disclosed in the above-mentioned Japanese Patent Unexamined Publication No. Sho. 61-270043 has realized a frame which is free from a thermal displacement and a rotatively supporting means with which the main spindles are not thermally expanded. On the other hand, this conventional grinder has the feeding mechanism comprising the rack or the ball screw which is operated by the motor serving as the drive source and having the structure that the grinding heads are vertically guided along the sliding surfaces, so that there is a problem that the conventional grinder cannot substantially perform precise feeding because of a sliding resistance or the like.

Further, in the conventional grinder, the motors which are drive sources for vertically moving the grinding heads and the ball screws are disposed on the sides of the spindles for rotating the grinding wheels, so that a lateral load is applied to the spindle. Accordingly, there is a great possibility that smooth and precise feeding cannot be performed and intercepted.

SUMMARY OF THE INVENTION

The present invention has been found to overcome the problems experienced with the conventional techniques.

It is an object of the present invention to provide a grinder and grinding method which is capable of precisely feeding and moving grinding wheels to predetermined grinding positions to grind a hard material, such as a semiconductor wafer.

In addition, it is also object of the present invention to provide a grinder and grinding method which is capable of exhibiting sufficient rigidity and performing a precise grinding operation.

Further, it is an object of the present invention to provide a grinder of twin head type capable of adjusting the levelness (horizontal inclination) of the grinding wheel so as to grind the both side surfaces of work precisely and to make the same parallel.

The object of the present invention can be achieved by a grinder that includes the following:

- a first grinding wheel drive unit stood erect in a vertical direction, the first grinding wheel drive unit including a first spindle rotatable and a first housing for rotatably supporting the first spindle;
- a first grinding wheel held at an end of the first spindle;
- a first feeding means for moving the first housing in the vertical direction, the first feeding means having a mechanism for converting rotational movement into linear movement; and
- a first hydrostatic radial bearing for movably supporting the first housing.

In the above-mentioned construction of the grinder according to the present invention, advantageously, the first feeding means comprises a motor, a ball screw and a nut portion which are coupled with one another, and the ball screw is coaxially disposed with the first housing.

In the above-mentioned construction of the grinder according to the present invention, advantageously, the first grinding wheel drive unit includes:

- a second hydrostatic radial bearing provided within the first housing for directly and rotatably supporting the first spindle; and
- a first hydrostatic thrust bearing for rotatably supporting the first spindle.

The above-mentioned construction of the grinder according to the present invention, more advantageously, further includes:

- a first supplemental feeding means for moving the first grinding wheel in a vertical direction, the first supplemental feeding means having a first pressure regulating mechanism capable of regulating the pressure of a fluid in the first hydrostatic thrust bearing which rotatively supports the first spindle.

In the above-mentioned construction of the grinder according to the present invention, advantageously, the first hydrostatic radial bearing includes a plurality hydrostatic radial bearing portions which are separated from each other in the vertical direction.

The above-mentioned construction of the grinder according to the present invention, advantageously, further includes:

a second grinding wheel drive unit disposed opposite to the first grinding wheel drive unit and stood erect in a vertical direction, the second grinding wheel drive unit including a second spindle rotatable and a second housing for rotatably supporting the first spindle;

a second grinding wheel held at an end of the second spindle in a state in which the second grinding wheel is held in parallel substantially with and opposite to the first grinding wheel; and a second feeding means for moving the second housing in the vertical direction, the second feeding means having a mechanism for converting rotational movement into linear movement; and is a third hydrostatic radial bearing for movably supporting the second housing.

In the above-mentioned construction of the grinder according to the present invention, advantageously, the second feeding means has a motor, a ball screw and a nut portion which are coupled with one another, and the second housing is coaxially disposed with the ball screw.

In the above-mentioned construction of the grinder according to the present invention, advantageously, the second housing includes:

a fourth hydrostatic radial bearing for rotatably supporting the second spindle; and a second hydrostatic thrust bearing for rotatably supporting the second spindle.

The above-mentioned construction of the grinder according to the present invention, advantageously, further includes:

a second supplemental feeding means for moving the second spindle in the vertical direction, the second supplemental feeding means having a second pressure regulating mechanism capable of regulating the pressure of a fluid in the second hydrostatic thrust bearing which rotatively supports the second spindle.

In the above-mentioned construction of the grinder according to the present invention, advantageously, the third hydrostatic radial bearing comprises a plurality of hydrostatic radial bearing portions which are separated from each other in the vertical direction.

Note that the above-mentioned object can be achieved by a grinder, according to the present invention, includes:

a first grinding wheel drive unit stood erect in a vertical direction, and having a first spindle rotatable and a first supporting member for rotatably supporting the first spindle;

a first grinding wheel held at an end of the first spindle;

a first feeding means for moving the supporting member in the vertical direction, the first feeding means having a mechanism for converting rotational movement into linear movement;

a first hydrostatic thrust bearing for rotatively supporting the first spindle; and a second feeding means for moving the first grinding wheel in a vertical direction, the second feeding means having a first pressure regulating mechanism capable of regulating the pressure of a fluid in the first hydrostatic thrust bearing.

In the above-mentioned construction of the grinder according to the present invention, advantageously, the regulation of the pressure of the fluid in the first hydrostatic thrust bearing is performed by changing the back pressure of the hydrostatic thrust bearing.

In the above-mentioned construction of the grinder according to the present invention, advantageously, the first pressure regulating mechanism includes:

a fluid pressure generating device;

two fluid supply pipe passages for allowing the fluid pressure generating device to communicate with the first hydrostatic thrust bearing to supply the fluid therein;

a supply pressure regulating mechanism provided at least one of the two fluid supply pipe passages.

In the above-mentioned construction of the grinder according to the present invention, advantageously, the supply pressure regulating mechanism has an apparatus for adjusting a restriction of the fluid.

In the above-mentioned construction of the grinder according to the present invention, advantageously, the first spindle has a flange portion projecting radially, the first hydrostatic thrust bearing rotatably supports the flange portion, and an opening of one of the two fluid supply pipe passages faces the upper surface of the flange portion, and an opening of the other fluid supply pipe passage faces the lower surface of the flange portion.

In the above-mentioned construction of the grinder according to the present invention, advantageously, each of the fluid supply pipe passages is respectively provided with an apparatus for adjusting a restriction of the fluid.

The above-mentioned construction of the grinder according to the present invention, advantageously, further includes:

a second grinding wheel drive unit disposed opposite to the first grinding wheel drive unit and stood erect in the vertical direction, the second grinding wheel drive unit including a second spindle rotatable and a second supporting member for rotatably supporting the first spindle;

a second grinding wheel held at an end of the second spindle in a state in which the second grinding wheel is held in parallel substantially with and opposite to the first grinding wheel; and a third feeding means for moving the second supporting member in the vertical direction, the third feeding means having a mechanism for converting rotational movement into linear movement.

The above-mentioned construction of the grinder according to the present invention, advantageously, further includes:

a second hydrostatic thrust bearing for rotatively supporting the second spindle; and a fourth feeding means for moving the second spindle in the vertical direction, the fourth feeding means having a second pressure regulating mechanism which is capable of regulating the pressure of the fluid in the second hydrostatic thrust bearing.

In the above-mentioned construction of the grinder according to the present invention, advantageously, the first grinding wheel drive unit has a drive motor for rotating the first spindle, the first feeding means has a motor, a ball screw and a nut portion which are coupled with one another, and the axial line of the ball screw, a rotational axis of the drive motor and the axial line of the first spindle are in line with one another.

In the above-mentioned construction of the grinder according to the present invention, more advantageously, the first grinding wheel drive unit has a first drive motor for rotating the first spindle, the second grinding wheel drive unit has a second drive motor for rotating the second spindle, the first feeding means has a first motor, a first ball screw and a first nut portion which are coupled with one another, the third feeding means has a second motor, a second ball screw and a second nut portion which are coupled with one another, and the rotational axis of the first drive motor, the rotational axis of the second drive motor, the axial line of the first ball screw, the axial line of the first spindle, the axial line of the second ball screw and the axial line of the second spindle are in line with one another.

In the above-mentioned construction of the grinder according to the present invention, advantageously, regulation of the pressure of the fluid in the first hydrostatic thrust bearing of the second feeding means is performed by changing the back pressure of the first hydrostatic thrust bearing, and regulation of the pressure of the fluid in the second hydrostatic thrust bearing of the fourth feeding means is performed by changing the back pressure of the second hydrostatic thrust bearing.

In the above-mentioned construction of the grinder according to the present invention, more advantageously, the first feeding means has a first motor, a first ball screw and a first nut portion, the third feeding means has a second motor, a second ball screw and a second nut portion, and the axial line of the first ball screw, the axial line of the first spindle, the axial line of the second ball screw, the axial line of the second spindle, the axial line of the first hydrostatic thrust bearing and the axial line of the second hydrostatic thrust bearing are in line with one another.

In the above-mentioned construction of the grinder according to the present invention, more advantageously, the first pressure regulating mechanism comprises a first fluid pressure generating device, two fluid supply pipe passages for allowing the first fluid pressure generating device to communicate with the first hydrostatic thrust bearing, and a first supply pressure regulating mechanism provided at least one of the two fluid supply passages, and the second pressure regulating mechanism comprises a second fluid pressure generating device, two fluid supply passages for allowing the second fluid pressure generating device to communicate with the second hydrostatic thrust bearing, and a second supply pressure regulating mechanism provided for at least one of the two fluid supply passages.

In the above-mentioned construction of the grinder according to the present invention, more advantageously, the first spindle has a first flange portion projecting radially at an end thereof, the first hydrostatic thrust bearing rotatively supports the first flange portion, an opening of one of the two fluid supply pipe passages faces the upper surface of the first flange portion, and an opening of the other fluid supply pipe passage adjacent to the first hydrostatic thrust bearing faces the lower surface of the first flange portion, the second spindle has a second flange portion projecting radially at an end thereof, the second hydrostatic thrust bearing rotatively supports the second flange portion, and an opening of one of the two fluid supply passages faces the upper surface of the second flange portion, and an opening of the other fluid supply passage faces the lower surface of the second flange portion.

Further note that the above-mentioned object can be attained by a grinding method according to the present invention including:

a first feeding step of feeding a grinding wheel mounted on a spindle in a vertical direction while converting the motion from rotational movement into linear movement; and a second feeding step of feeding the grinding wheel in the vertical direction while regulating the pressure of the fluid in a hydrostatic thrust bearing which rotatively supports the spindle.

In the above-mentioned grinding method according to the present invention, advantageously, the first feeding step has a high-speed feeding step for feeding the grinding wheel at high speed to a position near a work to be ground by the grinding wheel, and a low-speed feeding step for feeding the grinding wheel at low speed to bring the grinding wheel into contact with the work after high-speed feeding has been performed.

In the above-mentioned grinding method according to the present invention, advantageously, the second feeding step comprises a precise feeding step in which more precise feeding interval as compared with the low-speed feeding step can be performed.

In the above-mentioned grinding method according to the present invention, advantageously, the amount of feeding in the second feeding step can continuously be changed.

In the above-mentioned grinding method according to the present invention, advantageously, the second feeding step comprises:

a precise feeding step in which more precise feeding interval as compared with the low-speed feeding step can be performed; and a finishing step of feeding the work in which more precise feeding interval as compared with the precise feeding step can be performed.

Further note that the above-mentioned object can be achieved by a grinding method, according to the present invention, comprising the steps of:

feeding in a vertical direction a housing which rotatably supports a spindle while said housing is being held by a hydrostatic radial bearing.

Furthermore note that the above-mentioned object can also be attained by a grinder, according to the present invention, includes:

an upper grinding wheel drive unit stood erect in the vertical direction;

an upper spindle rotatively disposed in the upper grinding wheel drive unit;

an upper motor for rotating the upper spindle;

an upper grinding wheel held at an end of the upper spindle;

an upper feeding means having a mechanism for converting rotational movement into linear movement and arranged to move the upper grinding wheel in the vertical direction, wherein the rotational axis of the upper motor, the rotational axis of the upper spindle, the rotational axis of the lower spindle and the axial line of the upper feeding means are in line with one another.

In the above-mentioned structure of the grinder according to the present invention, advantageously, further including precise feeding means having a first pressure regulating mechanism which is capable of regulating the pressure of a fluid in a first hydrostatic thrust bearing for rotatively supporting the first spindle and arranged to move the first grinding wheel in the vertical direction, wherein the axial line of the precise feeding means is in line with the axial line of the upper feeding means.

Moreover, note that the above-mentioned object can also be attained by a twin-head grinder, according to the present invention, includes:

an upper grinding wheel drive unit stood erect in the vertical direction;

an upper spindle rotatively disposed in the upper grinding wheel drive unit;

an upper motor for rotating the upper spindle;

an upper grinding wheel held at an end of the upper spindle;

upper feeding means having a mechanism for converting rotational movement into linear movement and arranged to move the first grinding wheel in the vertical direction;

upper precise feeding means having an upper pressure regulating mechanism which is capable of regulating the pressure of a fluid in the upper hydrostatic thrust bearing which rotatively support the upper spindle and arranged to move the upper grinding wheel in the vertical direction;

a lower grinding wheel drive unit disposed opposite to the upper grinding wheel drive unit and stood erect in the vertical direction;

a lower spindle rotatively dispose in the lower grinding wheel drive unit;

a lower motor for rotating the lower spindle;

a lower grinding wheel held at an end of the lower spindle in such a manner that the lower grinding wheel is held in parallel substantially with and opposite to the upper grinding wheel;

lower feeding means having a mechanism for converting rotational movement into linear movement and arranged to move the lower grinding wheel in the vertical direction; and lower precise feeding means having a lower pressure regulating means which is capable of regulating the pressure of the fluid in the lower hydrostatic thrust bearing which rotatively supports the lower spindle and arranged to move the lower grinding wheel in the vertical direction, wherein the rotational axis of the upper motor, the rotational axis of the lower motor, the rotational axis of the upper spindle, the rotational axis of the lower spindle, the axial line of the upper feeding means, the axial line of the lower feeding means, the axial line of the upper precise feeding means and the axial line of the lower precise feeding means are in line with one another.

In addition, note that the above-mentioned object can also be attained by a grinder, according to the present invention, including:

a grinding wheel drive unit stood erect in the vertical direction;

a spindle rotatively disposed in the grinding wheel drive unit;

a grinding wheel holder disposed at an end of the spindle; and a levelness adjustment apparatus for compensating the levelness of the grinding wheel holder by regulating the pressure of the fluid.

Furthermore, to achieve the object, according to one aspect of the present invention, there is provided a twin-head grinder having two grinding wheels which are moved in the axial direction while the two grinding wheels are rotated so that a work is ground, the twin-head grinder including: spindles for the grinding wheels arranged in such a manner that at least either of the spindles is rotatively borne by benches for the grinding wheels through a hydrostatic thrust bearing; and pressure regulating means for regulating the pressure of a fluid which is supplied to at least either of supply ports formed in the hydrostatic thrust bearing and allowed to communicate with each other in a direction opposite to each other in a direction of the axial line of the spindles.

When a work is ground by the above-mentioned twin-head grinder according to the present invention, the benches for the grinding wheels are quickly fed to positions adjacent to the work by the motors and the ball screws while the grinding wheels are rotated. Then, the feeding mode is switched to feeding for a grinding operation so that the work is ground in a quantity near a predetermined quantity. Finally, the pressure regulating means regulates the pressure of the fluid which is supplied to at least either of the supply ports of the hydrostatic thrust bearing. As a result, the bearing balance of the spindles in the axial direction realized by the hydrostatic thrust bearing is changed so that the grinding wheels are precisely fed and moved to predetermined grinding positions.

In the above-mentioned twin-head grinder according to the present invention, advantageously, the pressure regulating means has regulating means for changing the pressure by adjusting a restriction of the fluid.

Furthermore, in the above-mentioned twin-head grinder, advantageously, has the structure that the pressure regulating means comprises a regulating means for adjusting a restriction of the pressure. When the pressure is changed by the regulating means, the pressure of the fluid which must be supplied to the supply port of the hydrostatic thrust bearing can easily be regulated.

Moreover, To achieve the above-mentioned objects, according to one aspect of the present invention, there is provided a twin-head grinder having grinding wheel drive units which are stood erect and which include upper and lower spindles each of which can be rotated by a motor and arranged in such a manner that upper and lower grinding wheels are held substantially in parallel with and opposite to each other by the upper and lower spindles and a work is inserted into a space between the two grinding wheels so that the work is rotated and ground, the twin-head grinder including: first feeding means provided for each of the upper- and lower-grinding wheel drive units and each having a mechanism for converting each of the upper and lower grinding wheels from rotational movement into reciprocative straight movement so as to vertically move the upper and lower grinding wheels toward the work; and second feeding means provided for at least either of the upper- and lower-grinding wheel drive units, the second feeding means feeding the grinding wheel for a short distance by fluid pressure so as to precisely finish the work.

Each of the upper- and lower-grinding wheel drive units has the housing in the guide which is stood erect. Moreover, the spindle is rotatively disposed in the housing. To vertically move the grinding wheel by the first feeding means, the housing is vertically moved directly by the first feeding means. Since the mechanism for converting the rotational movement into the linear reciprocative movement is employed, the housing can quickly be fed so as to be allowed to approach the grinding wheel. Furthermore, the grinding wheel can be fed as it is so that the work is ground.

The second feeding means directly moves the spindle in the vertical direction. The second feeding means is provided for each of the upper- and lower-grinding wheel drive units, only the upper-grinding wheel drive unit or only the lower-grinding wheel drive unit. Moreover, a function is realized, with which feeding in sub-micron units which cannot easily be performed by the first feeding means, can be performed.

In the above-mentioned twin-head grinder according to the present invention, advantageously, the first feeding means incorporates a motor, a ball screw and a nut portion, and the axial line of the ball screw is made to be in line with the axial lines of the upper and lower spindles.

In the above-mentioned twin-head grinder according to the present invention, advantageously, the second feeding means supports the spindle by a hydrostatic thrust bearing and a hydrostatic radial bearing thereof and changes the back pressure of the hydrostatic thrust bearing so as to enable the spindle to move vertically.

The second feeding means is composed of the first hydrostatic radial bearing and a hydrostatic thrust bearing. The difference between the upper back pressure and the lower back pressure of the thrust bearings is used so that the spindles are moved precisely.

In the above-mentioned twin-head grinder according to the present invention, advantageously, the axial line of the upper spindle and the axial line of the lower spindle are made to be in line with each other, and axial lines of the upper and lower motors for rotating the upper and lower spindles, the first feeding means and the second feeding means are made to be in line with the axial lines of the upper and lower spindles.

The structure that the axial lines of the foregoing six units are made to be in line with the axial lines of the spindles means a structure that the axial lines of drive sources are made to be in line with those of the spindles in place of the structure in which motors for rotating the spindles are disposed on the side of the spindles so as to rotate the spindles by belts. Specifically, the above-mentioned structure can be realized by built-in type motors. Moreover, the drive source for generating the force for rotating the first feeding means and the linear reciprocative movement conversion mechanism are disposed to be in line with one another. In addition, the second feeding means is structured in such a manner that the force for the feeding operation is generated on the same axial line. Thus, the upper and lower spindles, the upper and lower first and seventh motors and the first and second feeding means are disposed in line with one another. As a result of the above-mentioned structure, the overall structure of the grinder has a symmetrical structure with respect to the axial lines of the spindles. Therefore, significantly stable mechanical rigidity can be realized and an extremely precise grinding operation can be performed.

The nature, utility and principle of the invention will be more clearly understood from the following detailed description and the appended claims when read in conjunction with the accompanying drawings.

DETAILED DESCRIPTION OF THE PREFERRED EMBODIMENTS

A first embodiment of the twin-head grinder according to the present invention will now be described with reference to the drawings.

Figure 1:
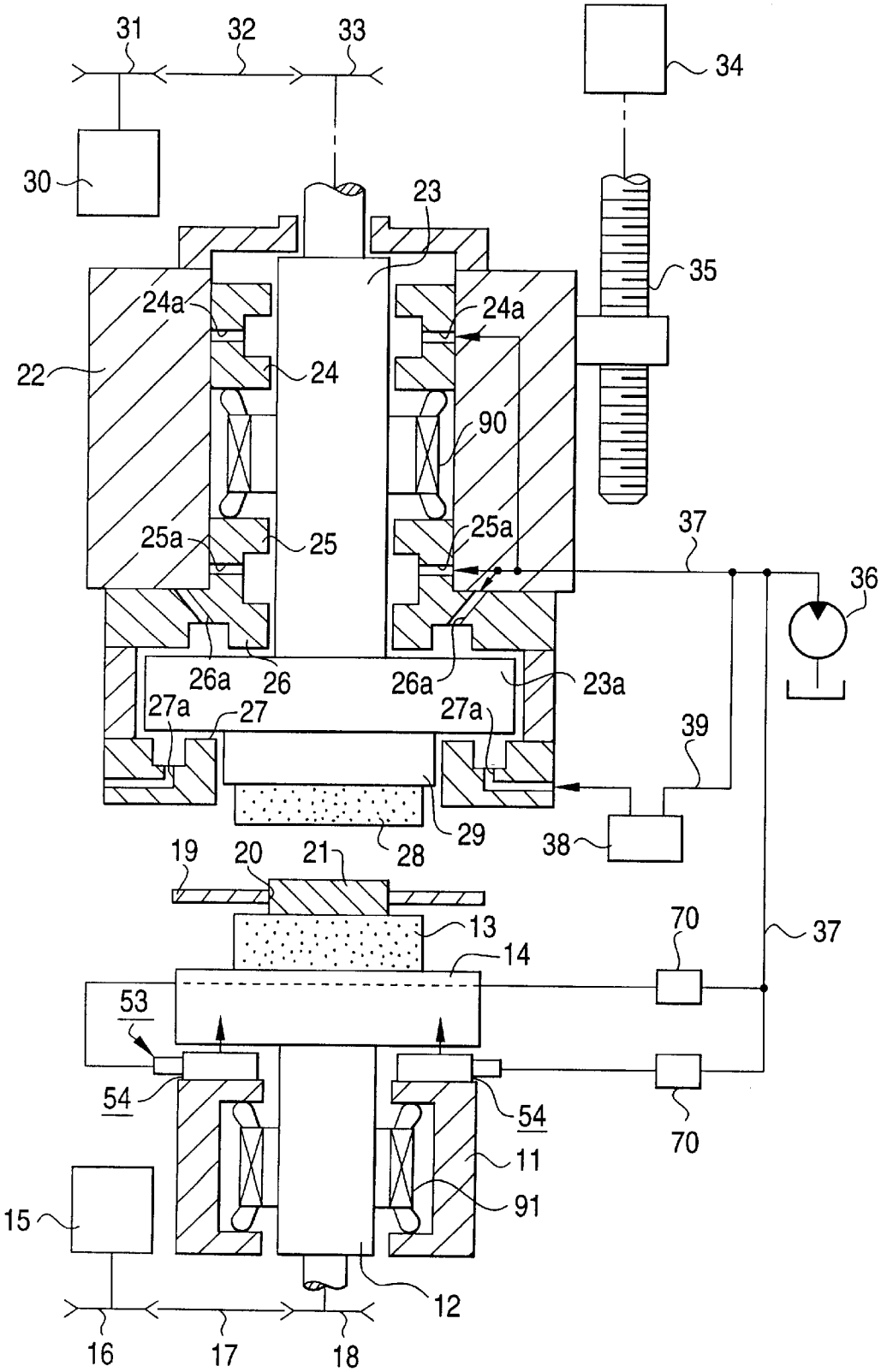
FIG. 1 is cross sectional view showing an essential portion of an embodiment of a twin-head grinder according to the present invention.

As shown in FIG. 1, a lower spindle head 11 is mounted on a lower frame (not shown). A lower spindle 12 is rotatively supported in the central portion of the lower spindle head 11. A lower grinding wheel 13 is mounted through a grinding wheel holder 14 formed integrally with the top end portion of the lower spindle 12. A modifying motor 15 which is rotated when the grinding wheel is modified/corrected by a dressing operation is mounted on the side surface of the lower spindle head 11. When the modifying motor 15 is rotated, the lower grinding wheel 13 is rotated at low speed through a pulley 16, a belt 17, a pulley 18 and a lower spindle 12 for the purpose of modifying/correcting the grinding wheel 13. A lower machining motor 91 for rotating the grinding wheel holder 14 is included in the lower spindle head 11 so that the lower grinding wheel 13 is rotated at high speed when the work is machined.

A work holder 19 is disposed on a lower frame in such a manner that the work holder 19 is positioned adjacent to a position above the lower grinding wheel 13. A work holding through hole 20 is formed in the central portion of the work holder 19. A work 21 is inserted into the work holding through hole 20 of the work holder 19 in such a manner that a projection formed on the work holder 19 (not shown) and a groove formed on the work 21 are engaged to each other. Thus, the work 21 and the work holder 19 are rotated by a motor (not shown). When a machining operation is performed, the work 21 is rotated at low speed. Moreover, the lower surface of the work 21 is mounted on the lower grinding wheel 13.

The upper spindle head 22 is mounted on an upper frame (not shown) in such a manner that the upper spindle head 22 can be moved vertically so that the upper spindle head 22 is disposed above the lower spindle head 11. To cause the upper spindle 23 to extend in line with the lower spindle 12 when the work 21 is machined, the upper spindle 23 is rotatively supported in the central portion of the upper spindle head 22 through pairs of hydrostatic radial bearings 24 and 25 and hydrostatic thrust bearings 26 and 27. An upper grinding wheel 28 is mounted on a grinding wheel holder 29 formed integrally with the lower end of the upper spindle 23.

The hydrostatic radial bearings 24 and 25 have supply ports 24*a* and 25*a* for supplying oil serving as a pressure fluid to the outer surface of the upper spindle 23. The hydrostatic thrust bearings 26 and 27 have supply ports 26*a* and 27*a* for supplying oil to the two opposed end surfaces of a flange portion 23*a* of the upper spindle 23.

A grinding wheel modifying motor 30 is mounted on the side surface of the upper spindle head 22. When the motor 30 is rotated, the upper grinding wheel 28 is rotated at low speed through a pulley 31, a belt 32, a pulley 33 and the upper spindle 23.

An upper machining motor 90 is included in the upper spindle head 22 so as to rotate the upper grinding wheel 28 at high speed when the work is machined. A grinding wheel feeding motor 34 is mounted on an upper frame (not shown). When the motor 34 is rotated, the upper spindle head 22 is, through a ball screw 35, quickly fed to a position near the work 21, and then fed at low speed to a predetermined machining position through a guide (not shown).

A hydrostatic pump 36, which is a fluid supply source, is connected to the supply ports 24*a* and 25*a* of the hydrostatic radial bearings 24 and 25 and the supply port 26*a* of the hydrostatic thrust bearing 26 through a supply pipe passage 37 and to the supply port 27*a* through a supply pipe passage 39. The fluid under predetermined pressure is supplied from the hydrostatic pump 36 to the supply ports 24*a*, 25*a*, 26*a* and 27*a* through the supply pipe passages 37 and 39.

A pressure regulator 38, which acts as a pressure regulating means, is connected to the supply pipe passage 39 extending from the hydrostatic pump 36 to the supply port 27*a* of the hydrostatic thrust bearing 27. After the upper spindle head 22 has quickly been fed to a position near the work 21 by the motor 34 and the ball screw 35, a grinding operation is started in such a manner that the upper spindle head 22 is precisely fed. Then, the pressure regulator 38 regulates the pressure of the fluid which is supplied from the hydrostatic pump 36 to the supply port 27*a* of the hydrostatic thrust bearing 27. Thus, the upper spindle 23 is furthermore precisely fed so that the upper grinding wheel 28 is moved downwards for a small distance to the predetermined grinding position.

Figure 2:
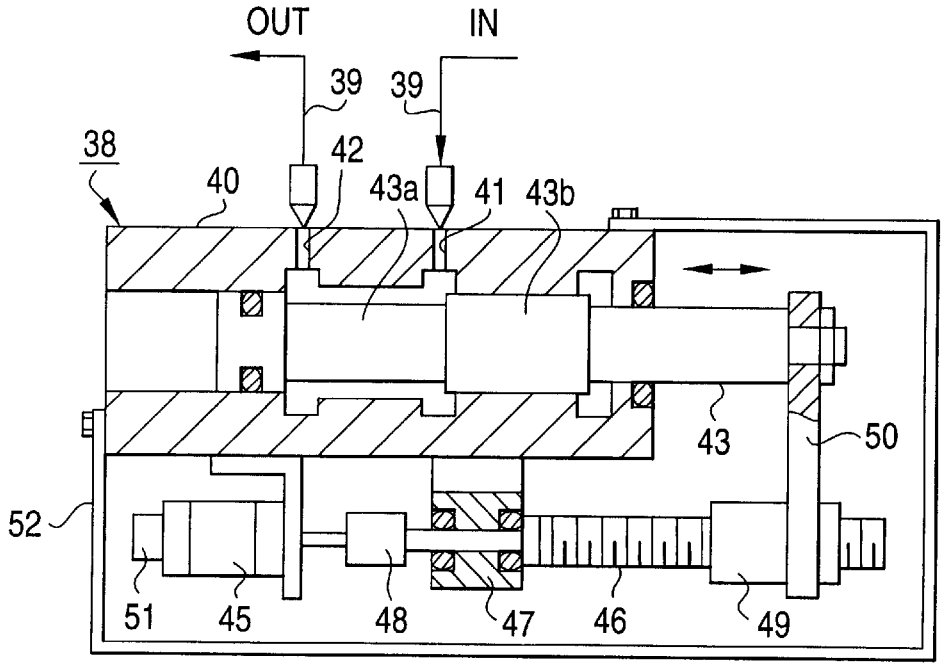
FIG. 2 is an enlarged cross sectional view showing a pressure regulator of a grinding wheel feeding unit.
Figure 3:
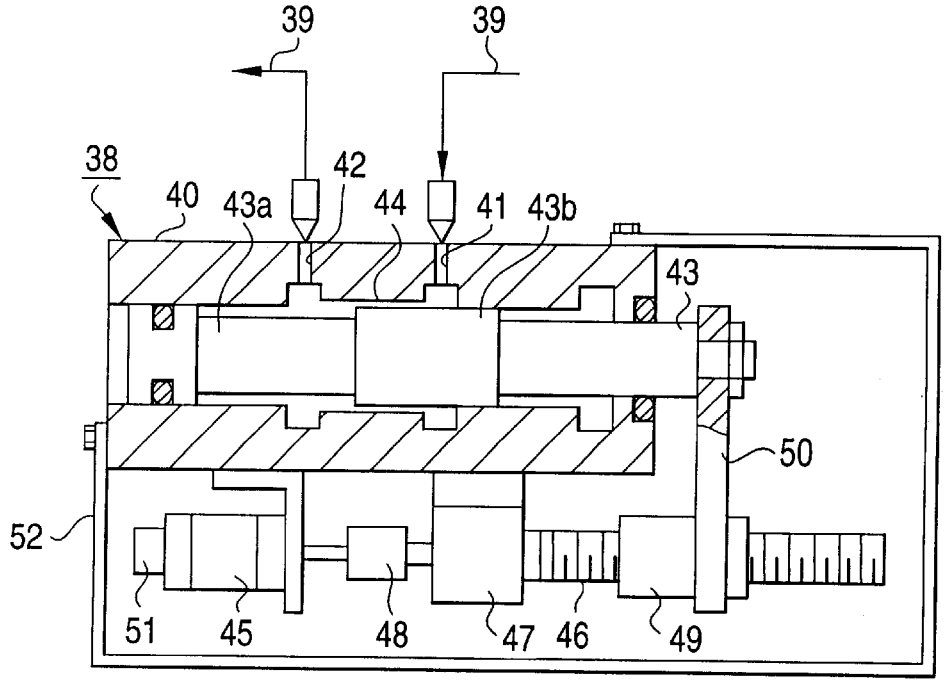
FIG. 3 is a cross sectional view showing a state of an operation of the unit shown in FIG. 2.
Figure 4:
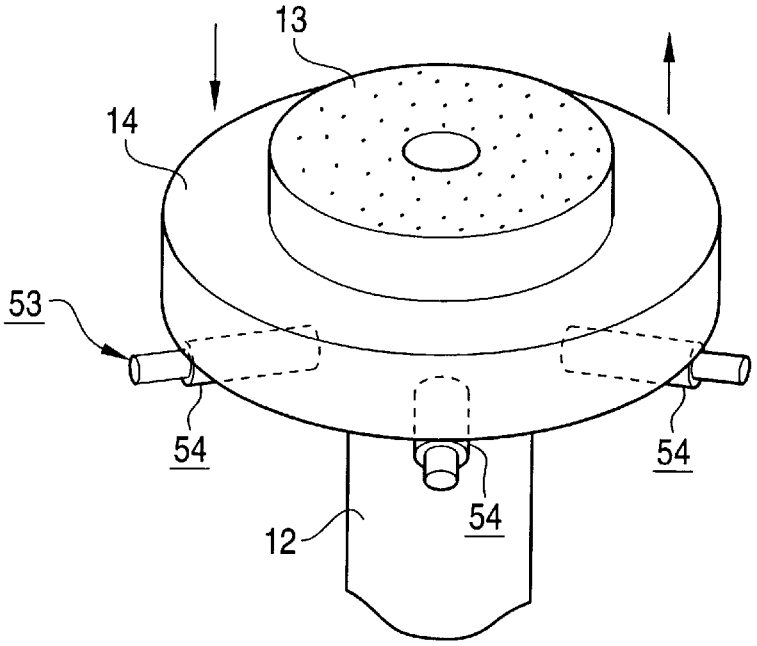
FIG. 4 is a perspective view showing an essential portion of an apparatus for adjusting the levelness of a lower grinding wheel.

As shown in FIG. 2, a fluid inlet port 41 and a fluid outlet port 42 are, apart from each other for a predetermined distance, formed in the outer surface of a housing 40 of the pressure regulator 38. An adjustment rod 43 is movably inserted into the housing 40. A small-diameter portion 43*a* and a large-diameter portion 43*b* are provided on the outer surface of the adjustment rod 43. When the adjustment rod 43 has been moved to the left, the large-diameter portion 43*b* is moved to the left within a region between the fluid inlet port 41 and the fluid outlet port 42, as shown in FIG. 3. Thus, a choking passage 44 is formed among the fluid inlet port 41, the fluid outlet port 42 and the small-diameter portion 43*a*.

A regulating motor 45 constituting an adjustment member, as an adjustment means, is mounted on the outer surface of the housing 40. A ball screw 46 is rotatively supported by the outer surface of the housing 40 through a bearing member 47 so as to be connected to a motor shaft of a regulating motor 45 through a coupling 48. A nut 49 is attached to an outer end of the adjustment rod 43 through a joining plate 50, and then threadedly engaged with the ball screw 46. An encoder 51 is attached to the regulating motor 45 so as to detect an amount of movement of the adjustment rod 43 in accordance with the number of revolutions of the regulating motor 45. A cover 52 is mounted on the housing 40 to cover the regulating motor 45, the encoder 51, the ball screw 46 and the nut 49.

When the regulating motor 45 is rotated in a state in which the small-diameter portion 43*a* of the adjustment rod 43 is disposed between the fluid inlet port 41 and the fluid outlet port 42 as shown in FIG. 2, the adjustment rod 43 is moved to the left in FIG. 2 through the ball screw 46 and the nut 49. As a result, as shown in FIG. 3, the large-diameter portion 43*b* of the adjustment rod 43 is moved to a position between the fluid inlet port 41 and the fluid outlet port 42. Thus, the choking passage 44 is formed among the fluid inlet port 41, the fluid outlet port 42 and the small-diameter portion 43*a*. The length of the choking passage 44 is changed in accordance with the distance for which the adjustment rod 43 has been moved. Therefore, as shown in FIG. 1, the pressure of the fluid which is supplied to the supply port 27*a* of the hydrostatic thrust bearing 27 is lowered in accordance with the length of the choking passage 44 thus formed. As a result, the bearing balance of the upper spindle 23 in the axial direction realized by the two hydrostatic thrust bearings 26 and 27 is changed so that the upper grinding wheel 28 is precisely downwards fed.

As shown in FIGS. 1 and 4 to 7, a levelness (horizontal inclination) adjustment unit 53 is disposed to correspond to the grinding wheel holder 14 of the lower grinding wheel 13, the levelness adjustment unit 53 having a plurality of (for example, eight in this embodiment) pressure regulators 54 disposed on the lower spindle head 11 apart from one another by predetermined intervals. The pressurized fluid is supplied from the hydraulic pump 36 to the lower surface of the grinding wheel holder 14 of the lower grinding wheel 13 through the supply pipe passage 37, valves 70 and each of the pressure regulators 54. The pressure of the fluid, that is, each of the pressure regulators 54 is adjusted so that the horizontal inclination of the lower grinding wheel 13 is adjusted. The plurality of the pressure regulators 54 correspond to the plurality of the valves 70.

That is, a fluid inlet port 56, which is connected to the supply pipe passage 37 extended from the hydraulic pump 36, is formed at an end of a housing 55 of the pressure regulators 54. Moreover, a fluid outlet port 57 allowed to communicate with the lower surface of the grinding wheel holder 14 is formed in the outer surface of the housing 55. An adjustment rod 58 is rotatively inserted into the housing 55. A fluid passage 59 allowed to communicate with the fluid inlet port 56 is formed in the central portion of the adjustment rod 58. Moreover, a choking passage 60 allowed to communicate with the fluid passage 59 and the fluid outlet port 57 is formed on the outer surface of the adjustment rod 58. The use of the levelness adjustment unit 53 is very effective and useful to prevent the work 21, the grinding wheel and the elements around them from being heated, because the adjustment of the levelness (horizonal inclination) of the grinding wheel in order of micron can be made with the levelness adjustment unit 53. Note that this heat generation which is occurred between the work and the grinding wheel being rotated in inclined state could not be avoided by using a prior art, particularly, a prior art utilizing the mechanical manner (such as a jack device).

An adjustment motor 61 is mounted on an end of the housing 55 through a bracket 62. A motor shaft of the adjustment motor 61 is connected to the adjustment rod 58 through a coupling 63. An encoder 64 is attached to the adjustment motor 61 so as to detect the amount of rotations of the adjustment rod 58 in accordance with the number of revolutions of the adjustment motor 61.

Figure 6:
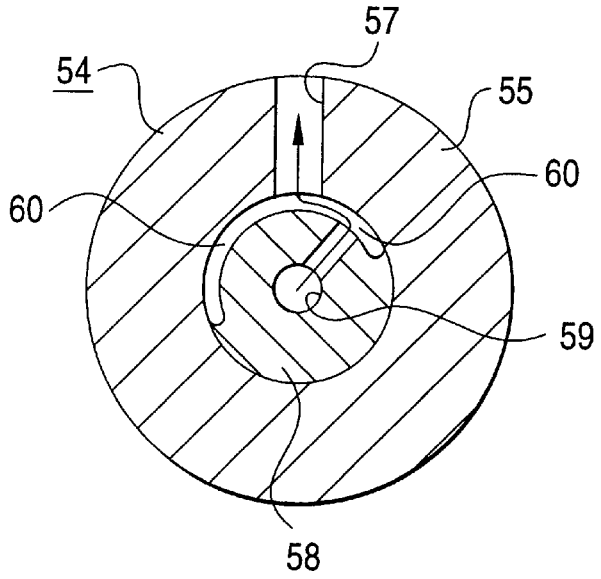
FIG. 6 is a cross sectional view taken along line VI—VI shown in FIG. 5.
Figure 7:
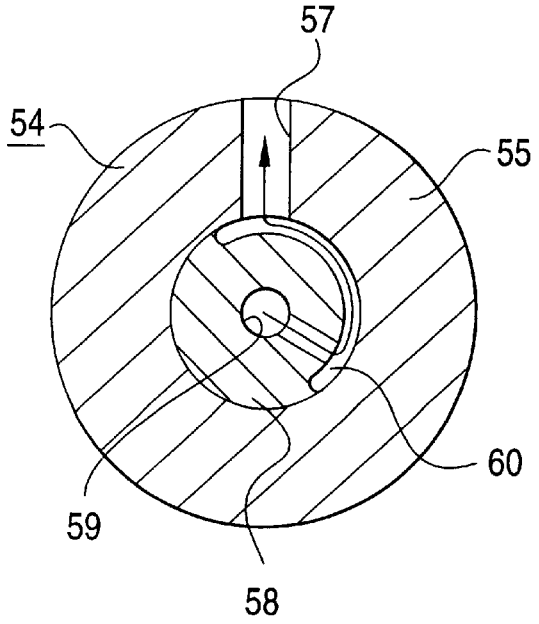
FIG. 7 is a cross sectional view showing a state of an operation of the unit shown in FIG. 6.

As shown in FIGS. 1, 6 and 7, the adjustment rod 58 is rotated by the adjustment motor 61 of a pressure regulator 54 previously selected by a control means (not shown). Thus, the length of the choking passage 60 interposed between the fluid passage 59 and the fluid outlet port 57 is changed. The pressure of the fluid which is supplied from the fluid outlet port 57 of the selected pressure regulator 54 to the lower surface of the grinding wheel holder 14 is changed so that the horizontal inclination of the lower grinding wheel 13 is precisely adjusted.

The operation of the twin-head grinder having the above-mentioned structure will now be described.

When the twin-head grinder is operated to perform the grinding operation, the work 21 is brought to a position at which the work 21 is brought into contact with the lower grinding wheel 13 in a state in which the work 21 is rotatively held by the work holder 19, as shown in FIG. 1. In the above-mentioned state, the lower grinding wheel 13 is rotated by the lower machining motor 91. Moreover, the upper grinding wheel 28 is rotated by the upper machining motor 90. The upper spindle head 22 is moved downwards by the grinding wheel feeding motor 34 through the ball screw 35 so that the upper grinding wheel 28 is quickly moved to the position near the work 21. Then, the feeding mode is switched to the low-speed mode for the machining operation so that the upper grinding wheel 28 is fed to the predetermined machining position.

When the feeding operation is performed by the grinding wheel feeding motor 34 and the ball screw 35, the small-diameter portion 43*a* of the adjustment rod 43 of the pressure regulator 38 is positioned between the fluid inlet port 41 and the fluid outlet port 42. Thus, the choking passage 44 does not exist among the fluid inlet port 41, the fluid outlet port 42 and the small-diameter portion 43*a*. Therefore, oil under predetermined pressure is supplied from the hydraulic pump 36 to the upper hydrostatic thrust bearing 26 through the supply pipe passage 37. Moreover, the fluid under the above-mentioned pressure is supplied to the lower hydrostatic thrust bearing 27 through the supply pipe passage 39 and the pressure regulator 38. Therefore, the upper spindle 23 is rotatively borne by the two hydrostatic thrust bearings 26 and 27 in such a manner that predetermined balance is maintained in the axial direction.

Then, the adjustment rod 43 is moved to the left by the regulating motor 45 of the pressure regulator 38, as shown in FIG. 3. Thus, the large-diameter portion 43*b* is moved so that the choking passage 44 is formed in the housing 40 at a position between the fluid inlet port 41 and the fluid outlet port 42. The length of the choking passage 44 is changed in accordance with the amount of movement of the adjustment rod 43.

Figure 8:
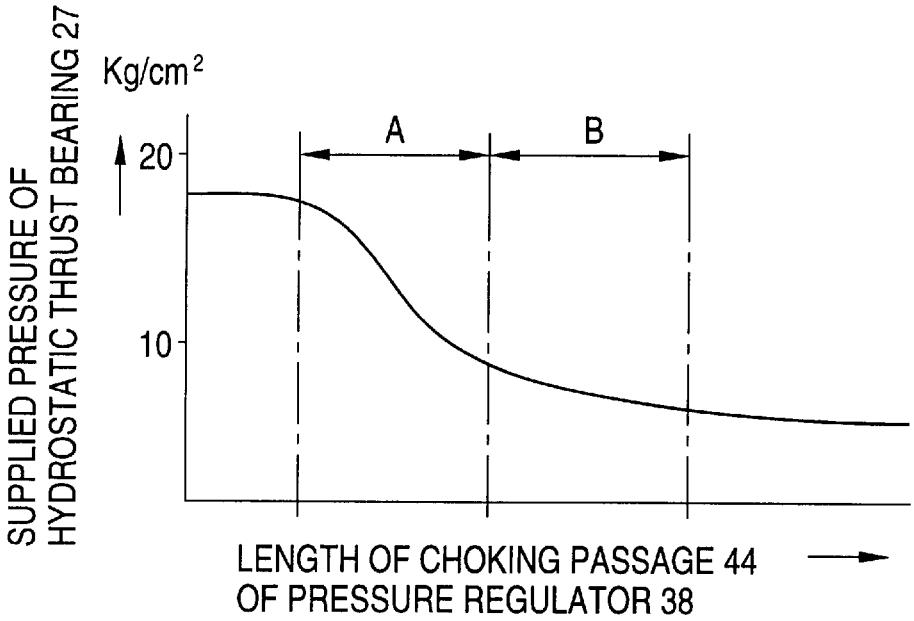
FIG. 8 is a graph showing the operation of the pressure regulator of the grinding wheel feeding unit.
Figure 9:
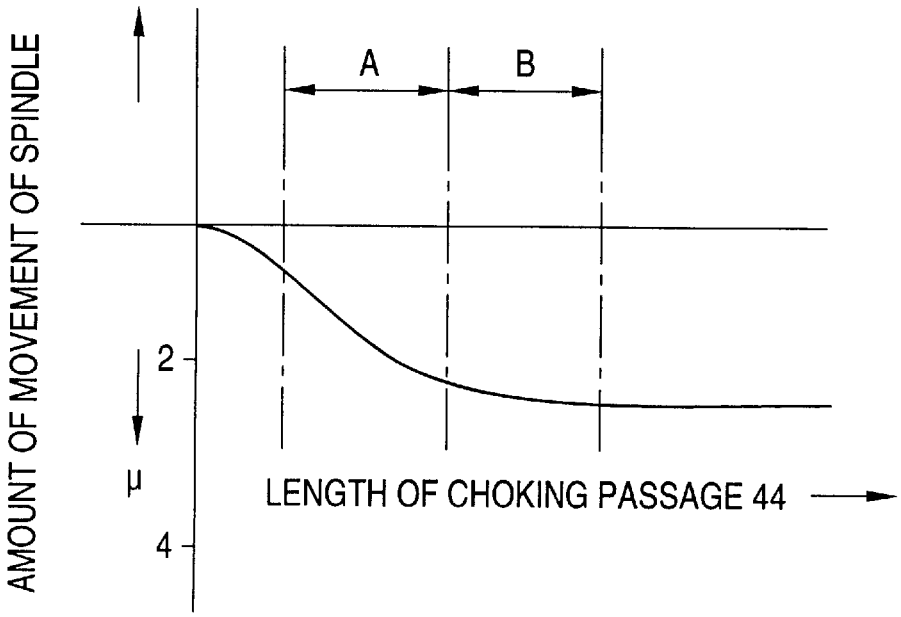
FIG. 9 is a graph showing an operation for feeding a bench for a grinding wheel which is performed by the pressure regulator.

In accordance with the change in the length of the choking passage 44 of the pressure regulator 38, the pressure of the fluid which is supplied to the lower hydrostatic thrust bearing 27 is lowered, as shown in FIG. 8. Since the pressure of the fluid is lowered as described above, the bearing balance of the upper spindle 23 realized by the two hydrostatic thrust bearings 26 and 27 is changed. As a result, the upper grinding wheel 28 is precisely moved in units of sub-microns, as shown in FIG. 9. Therefore, the upper grinding wheel 28 is accurately moved to the predetermined grinding position.

In accordance with the relationship between the length of the choking passage 44 and the amount of the movement of the spindle obtainable from FIGS. 8 and 9, the length of the choking passage, that is, the relationship between the amount of rotations of the regulating motor 45 and the amount of the movement of the upper spindle can be obtained. As a result, the upper spindle 23 can precisely be set.

As shown in FIG. 9, an influence of a pressure curve shown in FIG. 8 causes relatively great feeding to be realized in region A in the precise feeding operation. In region B, relatively small feeding can be realized in the precise feeding operation. Therefore, the region B is used to perform a final stage for feeding the grinding wheel.

Figure 10:
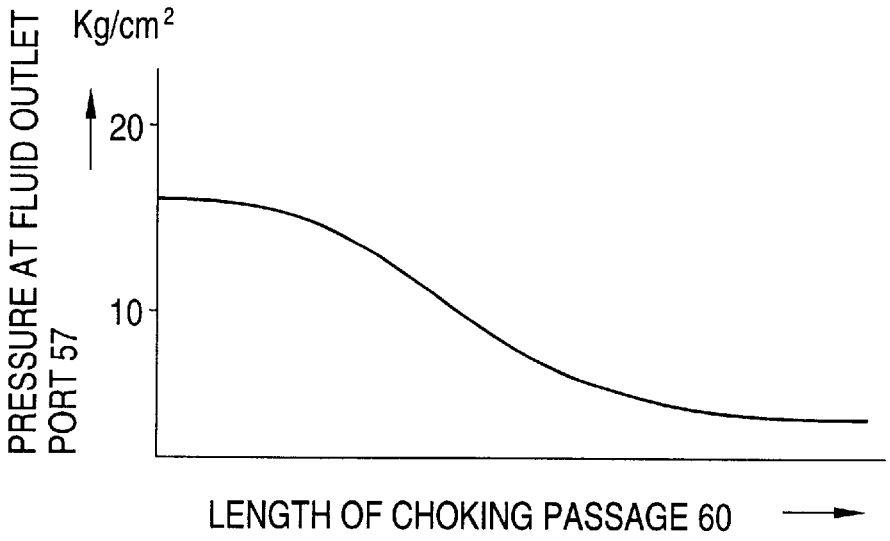
FIG. 10 is a graph showing an operation for a pressure regulator for the lower grinding wheel holder.
Figure 11:
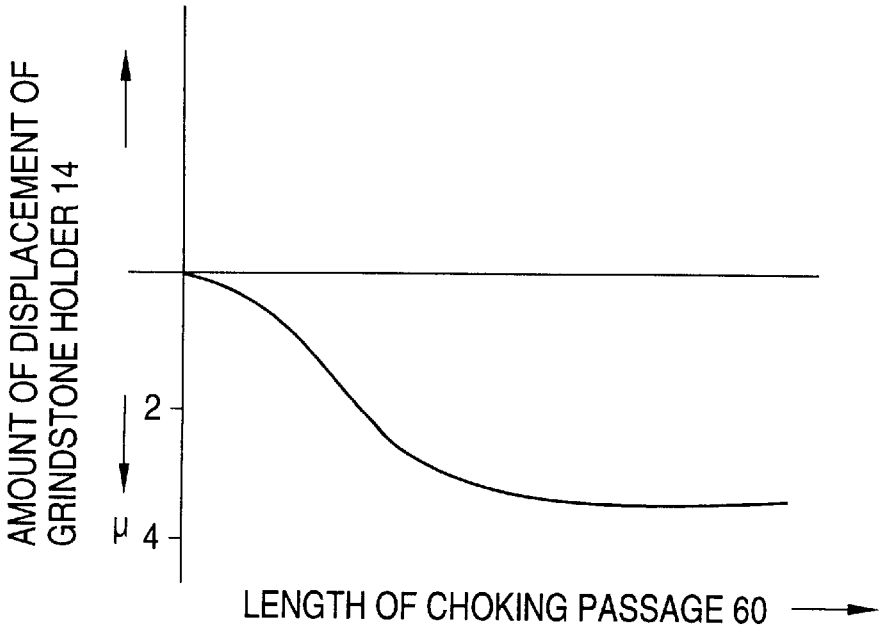
FIG. 11 is a graph showing an operation of the pressure regulator for feeding the grinding wheel holder.

The relationship between the length of the choking passage 60 of the plurality of the pressure regulators 54 and the pressure of the fluid at the fluid outlet port 57 of the pressure regulators 54 as shown in FIG. 10 can be obtained. In accordance with the obtained relationship, the relationship between length and the amount of downward deviation of the corresponding portion of the grinding wheel holder 14 which is brought into contact with the pressure regulators 54 as shown in FIG. 11 can be obtained.

As a result, the relationship between the length of the choking passage 60, that is, the adjustment motor 61 and the amount of the downward deviation of the contact portion of the grinding wheel holder 14 can be obtained. When a predetermined pressure regulator 54 is selected from the plurality of the pressure regulators 54, the precise angle of inclination of the grinding wheel holder 14 and the lower grinding wheel 13 can be adjusted.

An effect obtainable from the above-mentioned embodiment will now be described.

The twin-head grinder according to this embodiment has the structure that the upper spindle 23 of the upper grinding wheel 28 is rotatively borne by the upper spindle head 22 through the hydrostatic thrust bearings 26 and 27. The pressure regulator 38 serving as a pressure regulating means is provided which regulates the pressure of the fluid which must be supplied to the supply port 27*a* of the supply ports 26*a* and 27*a* of the hydrostatic thrust bearings 26 and 27.

Since the pressure of the fluid which must by supplied to the supply port 27*a* of the hydrostatic thrust bearing 27 is regulated by the pressure regulator 38, the upper grinding wheel 28 can precisely be fed to the predetermined grinding position. Moreover, a rigid and precise grinding operation can be performed.

The twin-head grinder according to this embodiment has the structure that the pressure regulator 38 is provided with the regulating motor 45 for changing the choking passage 44 and the length of the choking passage 44. When the length of the choking passage 44 is changed by the rotations of the regulating motor 45, the pressure of the fluid which must be supplied to the supply port 27*a* of the hydrostatic thrust bearing 27 can easily be adjusted. As a result, the upper grinding wheel 28 can precisely be fed.

The twin-head grinder according to this embodiment has the levelness adjustment unit 53 to correspond to the grinding wheel holder 14 of the lower grinding wheel 13. Thus, the pressurized fluid is supplied to the lower surface of the grinding wheel holder 14 of the lower grinding wheel 13 through each of the pressure regulators 54 of the levelness adjustment unit 53. When the pressure of the fluid discharged from the selected pressure regulator 54 is changed, the angle of inclination of the lower grinding wheel 13 can be adjusted. Therefore, the lower grinding wheel 13 can be adjusted to be in parallel substantially with the upper grinding wheel 28 so that the upper and lower grinding wheels 28 and 13 are able to precisely and in parallel machine the upper and lower surfaces of the work 21.

The following modification of the embodiment of the present invention will now be described.

The foregoing embodiment may be arranged in such a manner that the supply pipe passage 37 is connected to the lower hydrostatic thrust bearing 27 to supply the fluid under the predetermined pressure. Moreover, the pressure regulator 38 may be connected to the upper hydrostatic thrust bearing 26 so as to regulate the pressure of the fluid which must be supplied to the supply port 26*a*.

Another modification of the above-mentioned embodiment may be employed in which the pressure regulator 38 is connected to each of the upper and lower hydrostatic thrust bearings 26 and 27 so as to individually regulate the pressure of the fluid which must be supplied to each of the supply ports 26*a* and 27*a*.

Figure 5:
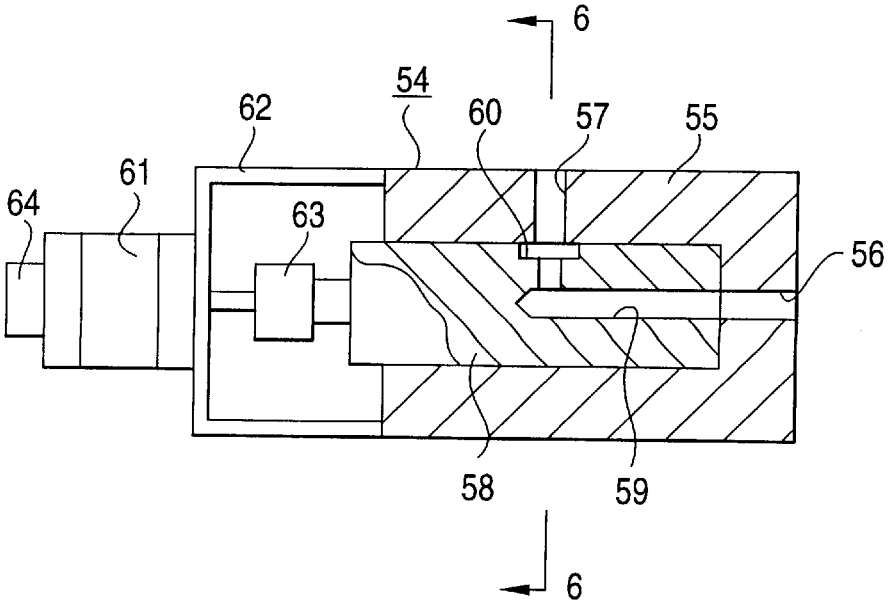
FIG. 5 is an enlarged cross sectional view showing a pressure regulator of a levelness adjusting apparatus.

A modification of the above-mentioned embodiment may be employed in which the means for regulating the pressure of the fluid which must be supplied to the hydrostatic thrust bearings 26 and 27 is a pressure regulator 54 having a rotative adjustment rod 58 as shown in FIGS. 5 to 7 in place of the pressure regulating valve 38 having the slidable adjustment rod 43 as shown in FIGS. 2 and 3.

A modification of the above-mentioned embodiment may be employed in which an operation handle or an operation button is connected to the ball screw 46 in place of the regulating motor 45 of the pressure regulator 38 for the grinding wheel feeding unit so as to move the adjustment rod 43 by manually operating the operation handle or the operation button.

The above-mentioned embodiment may be modified in such a manner that an operation handle or an operation button is connected to the adjustment rod 58 in place of the adjustment motor 61 of the pressure regulators 54 of the levelness adjustment unit 53 so as to rotate the adjustment rod 58 by manually operating the operation handle or the operation button.

Since the one aspect of the present invention has the above-mentioned structure, the following effect can be obtained.

The grinder according to the present invention enables the grinding wheels to precisely be fed to predetermined grinding positions. Thus, a precise grinding operation can be performed.

The one aspect of the present invention has the structure that the length of the choking passage of the pressure regulating means is changed. Thus, the pressure of the fluid which must be supplied to the supply portion of the hydrostatic thrust bearing can easily be regulated. As a result, the grinding wheel can precisely be fed.

A second aspect of the present invention has a essential structure that comprising:

a first grinding wheel drive unit stood erect in a vertical direction, said first grinding wheel drive unit including a first spindle rotatable and a first housing for rotatably supporting said first spindle;

a first grinding wheel held at an end of said first spindle;

a first feeding means for moving said first housing in the vertical direction, said first feeding means having a mechanism for converting rotational movement into linear movement; and a first hydrostatic radial bearing for movably supporting said first housing.

In addition to this structure, in the second embodiment described hereinafter, the second feeding means, which is capable of precisely feeding the grinding wheel, is optionally provided so as to grind the work more precisely.

Further to this structure in the second aspect of the present invention, the axial lines of the first and second feeding means are preferably made to be in line with each other in order to grind the work more precisely.

Note that the basic idea of the above mentioned structure according to the second aspect of the present invention applicable to both of a single head type grinder and a twin-head type grinder.

Figure 12:
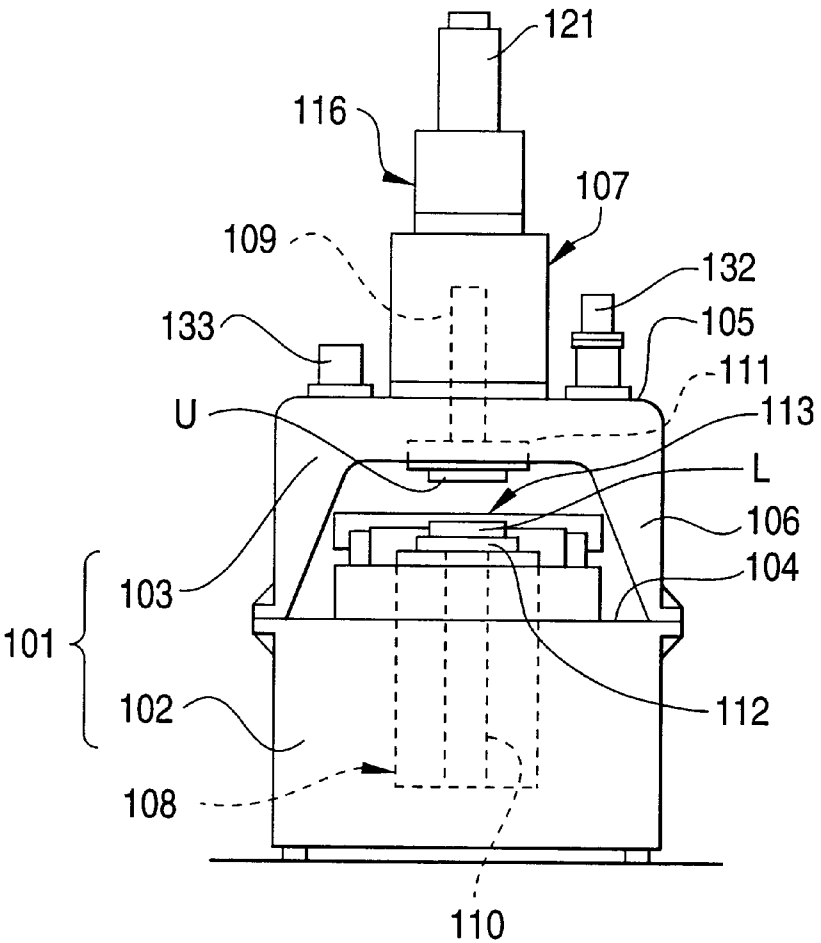
FIG. 12 is front view schematically showing a twin-head grinder as a second embodiment of the present invention.
Figure 13:
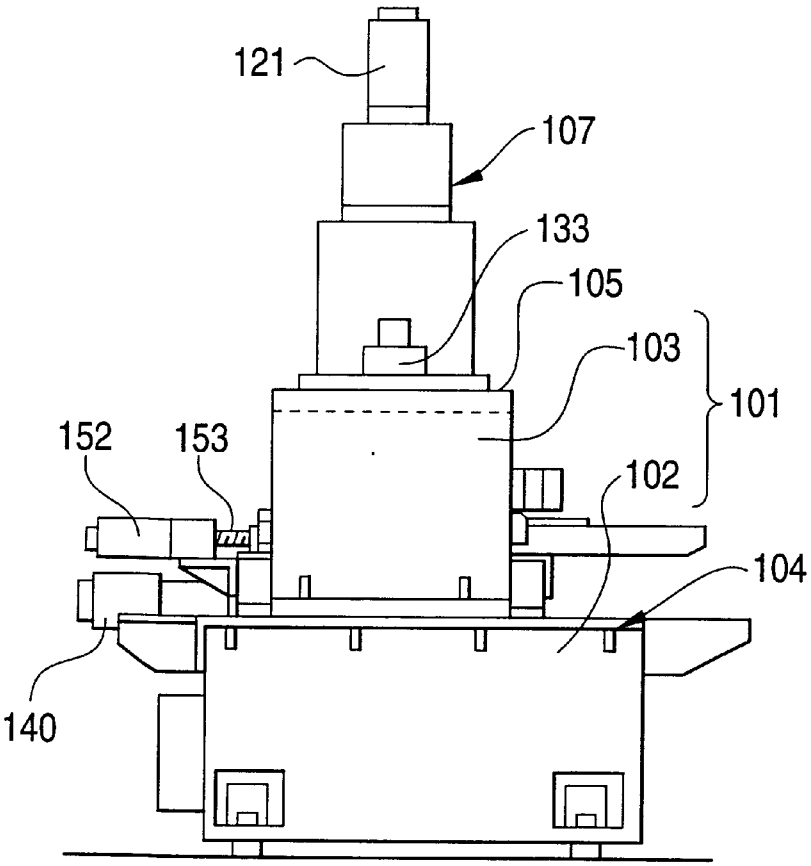
FIG. 13 is a side view showing the twin-head grinder.

A second embodiment according to the second aspect of the present invention having the structure that the second feeding means is optionally provided for the upper-grinding wheel drive unit will now be described. As shown in FIGS. 12 and 13, a frame 101 is formed by securing a table 103 to the upper surface of a bed 102. An opening portion is formed in the central portion of each of the upper plates 104 and 105 of the bed 102 and the table 103. The upper plate 105 of the table 103 is supported by a holder 106 composed of a plurality of walls or poles. Moreover, the upper plate 104 of the bed 102 and the upper plate 105 of the table 103 are made to be substantially in parallel with each other.

An upper-grinding wheel drive unit 107 is provided for the upper plate 105 of the table 103. Moreover, a lower-grinding wheel drive unit 108 is provided for the upper plate 104 of the bed 102. The spindles 109 and 110 disposed in the corresponding upper- and lower-grinding wheel drive units 107 and 108 are coaxially disposed in line with each other. An upper grinding wheel U is mounted to the lower surface of an upper grinding wheel holder 111 disposed at the lower end of the upper spindle 109, while a lower grinding wheel L is mounted to the upper surface of a lower grinding wheel holder 112 disposed at the upper end of the lower spindle 110. Moreover, a work support unit 113 is disposed between the upper and lower grinding wheels U and L.

Figure 14:
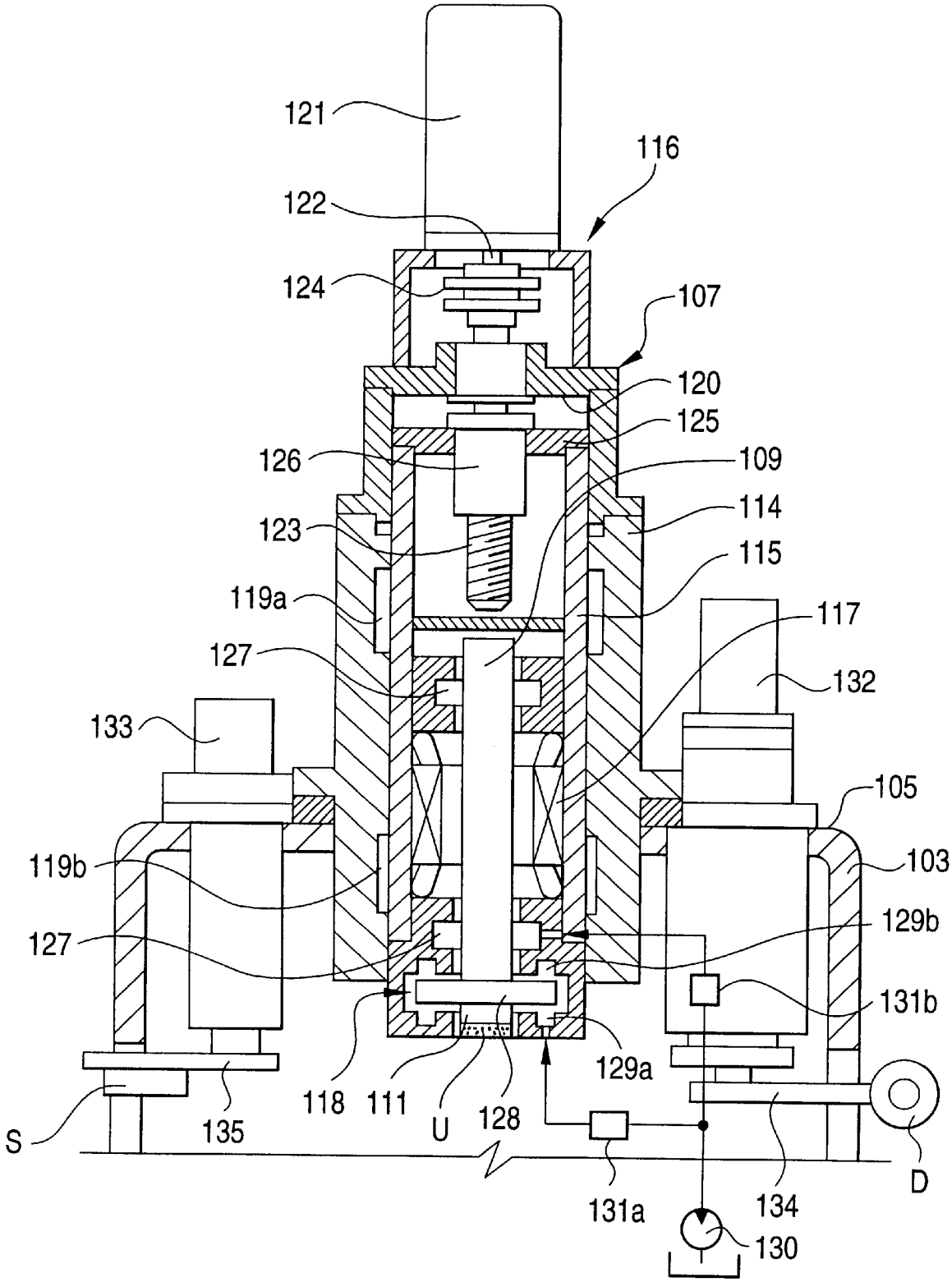
FIG. 14 is a cross sectional view showing an upper-grinding wheel drive unit of the twin-head grinder according to the present invention.
Figure 15:
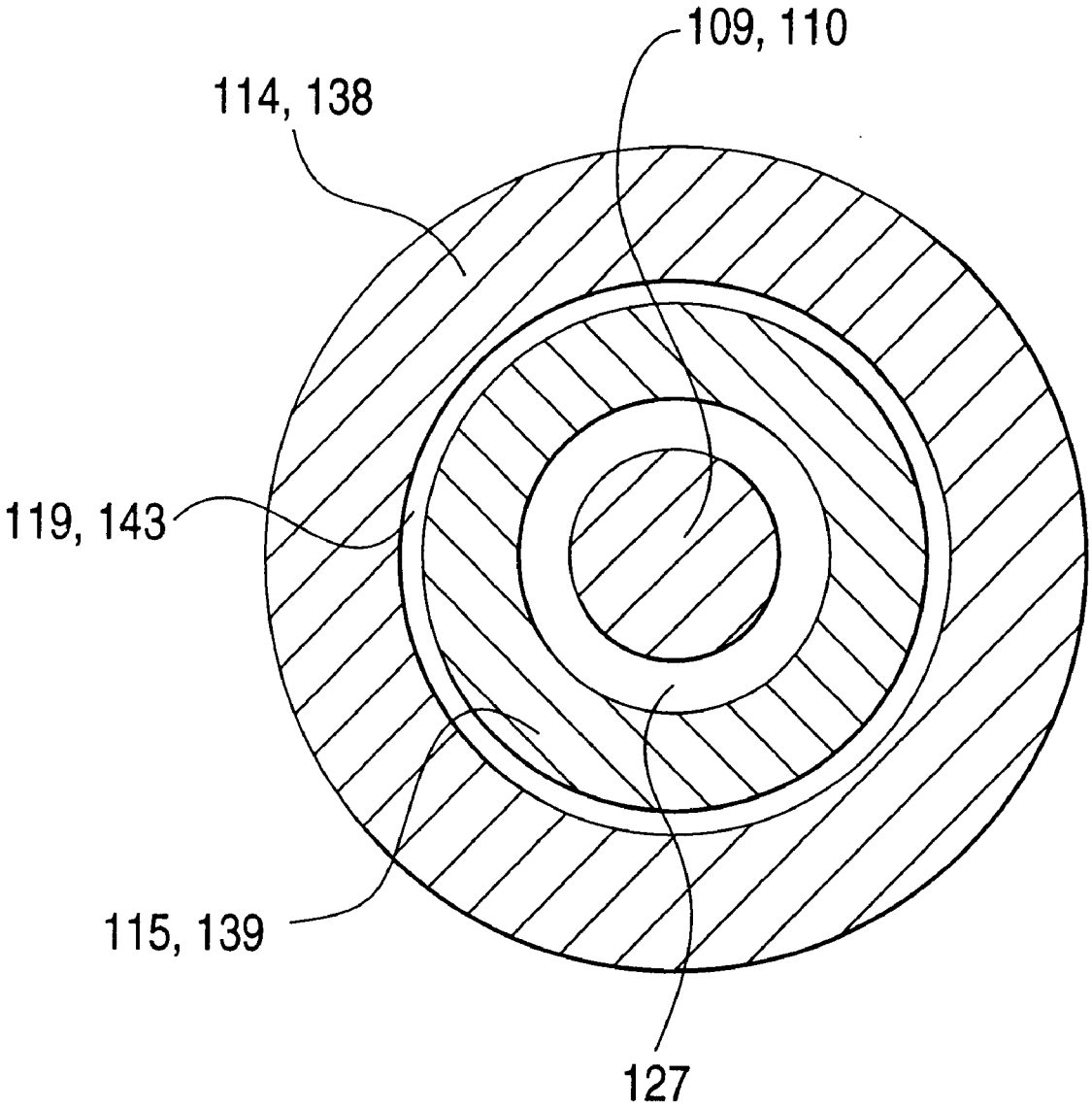
FIG. 15 is a lateral cross sectional view showing a hydrostatic radial bearing of the upper-grinding wheel drive unit.

As shown in FIG. 14, the upper-grinding wheel drive unit 107 provided for the table 103 has a structure that a cylindrical upper housing 115, which can vertically be moved by a first feeding means 116, is disposed in a cylindrical upper guide 114 secured to the table 103. The upper spindle 109, which is rotated by a first motor 117 and which can vertically be moved by a second feeding means 118, is disposed in the upper housing 115. Moreover, the upper housing 115 is supported by a first hydrostatic radial bearing 119 with respect to the upper guide 114, as shown in FIG. 15.

The first motor 117 for rotating the upper spindle 109 is a built-in type motor disposed in the upper housing 115. A stator of the first motor 117 is secured to the inner surface of the upper housing 115, while a rotor of the same is secured to the outer surface of the upper spindle 109. Since each of the upper housing 115 and the upper spindle 109 has a circular cross sectional shape, the axial line of the first motor 117 and that of the upper spindle 109 are in line with each other.

The first feeding means 116 is a mechanism for converting rotations of the motor into a linear reciprocative movement in the vertical direction. As shown in FIG. 14, a second motor 121 is secured to a head cap 120 which covers an upper end opening of the upper guide 114 in such a manner that the axial line of the second motor 121 is made to be in line with that of the upper spindle 109. A first ball screw 123 is, by a coupling 124, connected to an output shaft 122 of the second motor 121. On the other hand, a first nut portion 126 is provided for a top cap 125 secured to cover the top opening of the upper housing 115. The first ball screw 123 is threadedly engaged with and mounted to the first nut portion 126. When the second motor 121 is rotated, the upper housing 115 is vertically moved in the upper guide 114 through the first hydrostatic radial bearing 119*a* and 119*b* while the upper housing 115 is being supported by the first hydrostatic radial bearings 119*a* and 119*b*.

As shown in FIG. 14, the first hydrostatic radial bearings 119*a* and 119*b* are separated from each other in the vertical direction.

With a structure in which the upper housing 115 is rotatably supported by the first hydrostatic radial bearings 119*a* and 119*b*, it is possible to support the upper housing 115 through a liquid in a non-contact manner, so that there is no friction resistance between the upper housing 115 and the cylindrical upper guide 114. In addition to this, a rigidity of elements supporting the upper spindle 109 can be increased, so that the upper spindle can be fed precisely in order to sub-micron.

In addition to this, the upper housing 115, the second motor 121, the first ball screw 123, a coupling 124 and the first nut portion 126 are coaxially provided with one another, the rigidity of elements supporting the upper spindle 109 is further increased, so that the upper spindle can be fed more precisely.

As shown in FIG. 14, the second feeding means 118 has a structure that the second hydrostatic radial bearing 127 disposed above and below the first motor 117 in the upper housing 115 rotatively supports the upper spindle 109. Moreover, a flange 128 is provided at the lower portion of the upper spindle 109 at a position upper than the upper grinding wheel holder 111. The outer portion of the flange 128 is supported by hydrostatic thrust bearings 129*a* and 129*b* which hold the foregoing outer portion from upper and lower positions in the vertical direction. A fluid pump 130, which is specifically a hydraulic pump for supplying a pressurized fluid to the hydrostatic thrust bearings 129*a* and 129*b* and the second hydrostatic radial bearing 127, supplies pressurized fluid through the pressure regulators 131*a* and 131*b*. When the pressure regulators 131*a* and 131*b* have performed adjustment operations, their back pressures are changed. The difference in the pressure is used to precisely move the upper spindle 109 in the vertical direction. The second hydrostatic radial bearing 127 and the hydrostatic thrust bearings 129*a* and 129*b* are disposed on the outside of the upper spindle 109. Their axes are in line with the axial line of the upper spindle 109.

Third and fourth motors 132 and 133 are mounted to the table 103 provided with the upper-grinding wheel drive unit 107 in such a manner that the output shafts of the third and fourth motors 132 and 133 face downwards. Moreover, the third and fourth motors 132 and 133 are disposed on the line of the diameter of the upper guide 114 so as to be positioned opposite to each other. The third motor 132 rotates an arm 134 having a dresser D which is used when dressing of the grinding wheel is performed. The fourth motor 133 rotates an arm 135 having a sensor S for detecting abrasion of the grinding wheel.

Figure 16:
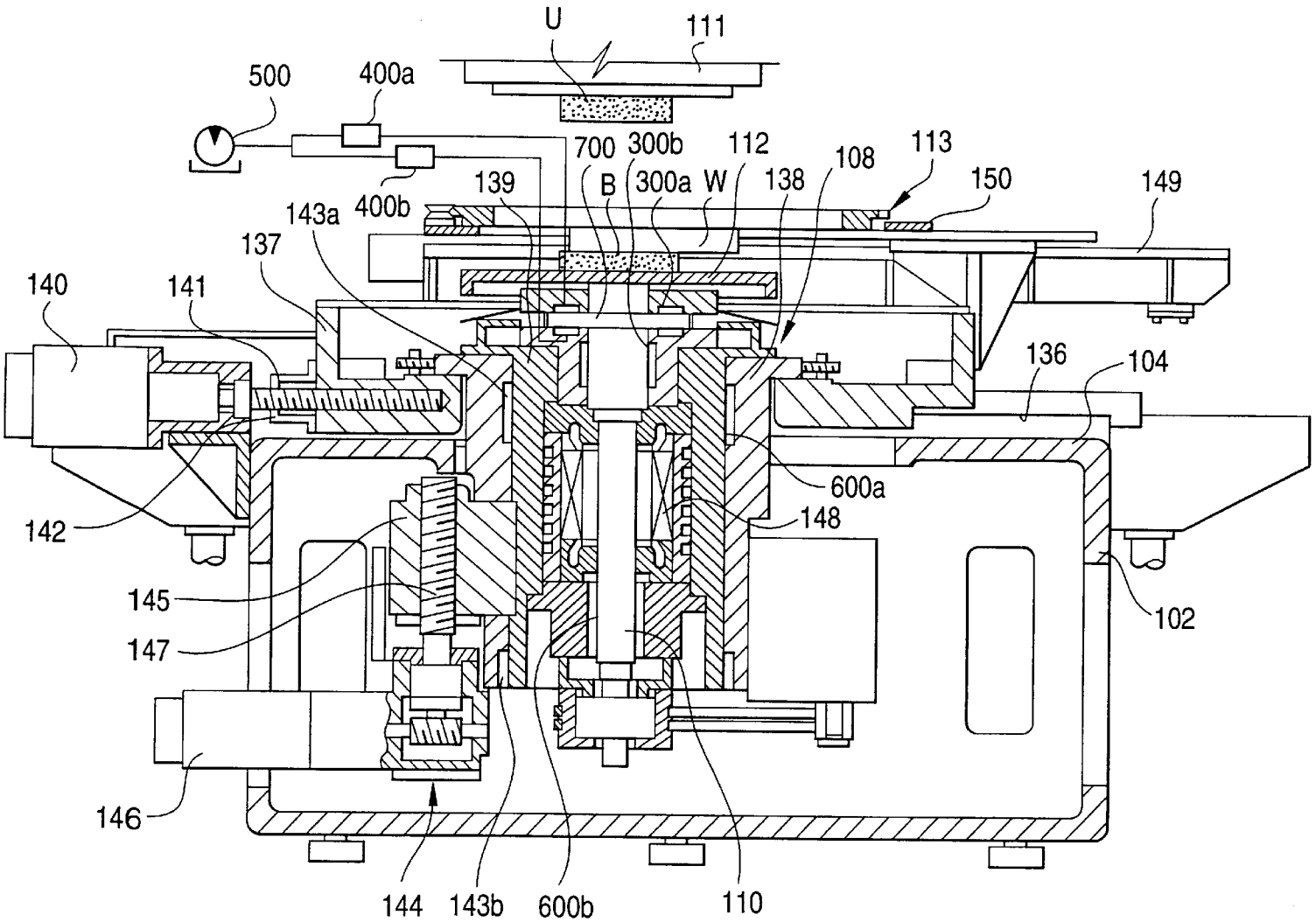
FIG. 16 is a cross sectional view showing a lower-grinding wheel drive unit.

As shown in FIG. 16, the lower-grinding wheel drive unit 108 has a saddle 137 which is capable of slidably moving along rails 136 provided for the upper plate 104 of the bed 102. The saddle 137 has a lower guide 138 extending downwards. The lower housing 139 is disposed within the lower guide 138 in such a manner that the lower housing 139 can be moved vertically. Moreover, the lower spindle 110 is rotatively disposed within the lower housing 139. The lower grinding wheel holder 112 is disposed at an upper end projecting over the lower housing 139 of the lower spindle 110. Moreover, the lower grinding wheel L is secured to the upper surface of the lower grinding wheel holder 112. When the position of the saddle 137 is adjusted, the axial line of the lower spindle 110 is made to coincide with the axial line of the upper spindle 109, and then a grinding operation is performed.

The saddle 137 is slidably moved by a structure formed by engaging, to a second nut portion 142 provided for the saddle 137, a second ball screw 141 which is rotated by a fifth motor 140 secured to the upper plate 104 of the bed 102. When the fifth motor 140 is rotated, the saddle 137 is slidably moved along the rails 136. The rails 136 have a guiding structure (not shown) in such a manner that one of the rails 136 is formed into a V-groove and the other one of the same has a flat shape. The saddle 137 is slidably moved so as to usually be positioned in the central portion of the bed 102 when the grinding operation is performed. When, for example, dressing of the upper grinding wheel U mounted on the upper-grinding wheel drive unit 107 is performed, the saddle 137 is retracted from the central portions so as to allow the dressing operation to be performed.

The lower housing 139 is engaged in the lower guide 138 in such a manner that the lower housing 139 is able to vertically be moved by a means arranged similarly to the upper-grinding wheel drive unit 107. As shown in FIGS. 15 and 16, the lower housing 139 is supported by a third hydrostatic radial bearings 143*a* and 143*b* with respect to the lower guide 138.

As shown in FIG. 16, the third hydrostatic radial bearings 143*a* and 143*b* are separated with other in the vertical direction.

Further, as shown in FIG. 14, the second upper feeding means 118 has a structure that the second hydrostatic radial bearing 127 disposed above and below the first motor 117 in the upper housing 115 rotatively supports the upper spindle 109. Moreover, a flange 128 is provided at the lower portion of the upper spindle 109 at a position upper than the upper grinding wheel holder 111. The outer portion of the flange 128 is supported by hydrostatic thrust bearings 129*a* and 129*b* which hold the foregoing outer portion from upper and lower positions in the vertical direction. A fluid pump 30, which is specifically a hydraulic pump for supplying a pressurized fluid to the hydrostatic thrust bearings 129*a* and 129*b* and the second hydrostatic radial bearing 127, supplies pressurized fluid through the pressure regulators 131*a* and 131*b*. When the pressure regulators 131*a* and 131*b* have performed adjustment operations, their back pressures are changed. The difference in the pressure is used to precisely move the upper spindle 109 in the vertical direction. The second hydrostatic radial bearing 127 and the hydrostatic thrust bearings 129*a* and 129*b* are disposed on the outside of the upper spindle 109. Their axes are in line with the axial line of the upper spindle 109.

The lower housing 139 is vertically moved with respect to the lower guide 138 by a first lower feeding means 144. In a usual case, the first lower feeding means 144 supports a work W mounted on the work support unit 113 at a position at which the work W must be supported. When the reverse side of the work W is ground, the lower grinding wheel L is moved upwards so as to be ground. When dressing is performed, the lower grinding wheel L is moved downwards to a position lower than the usual height. The first lower feeding means 144 has a short stroke and a structure not to vertically move the lower grinding wheel L during the machining operation.

As shown in FIG. 16, the structure of the first lower feeding means 144 is arranged in such a manner that a third nut portion 145 is formed to project over the outer surface of the lower housing 139. Moreover, a third ball screw 147 which is rotated by a sixth motor 146 secured to the side portion of the lower guide 138 is threadedly engaged with the third nut portion 145. When the sixth motor 146 is rotated, the lower housing 139 can vertically be moved.

The above-mentioned structure is arranged in such a manner that the axial line of the first lower feeding means 144 is made to be substantially in parallel to the lower spindle 110. The structure according to the present invention is not limited to this. The structure of the first feeding means 116 of the upper-grinding wheel drive unit 107 may have an inverted structure (not shown) so that the axial line of the first lower feeding means 144 coincides with the axial line of the lower spindle 110.

Further, as shown in FIG. 16, a lower second feeding means 300 which is substantially the same as that of the upper-grinding wheel drive unit 107 is provided. That is, a flange radially expanded from the lower spindle 110 is provided at the upper portion of the lower spindle 110 at a position lower than the upper grinding wheel holder 111. The outer portion of the flange 700 is supported by hydrostatic thrust bearings 300*a* and 300*b* which hold the foregoing outer portion from upper and lower positions in the vertical direction. A fluid pump 500, which is specifically a hydraulic pump for supplying a pressurized fluid to the hydrostatic thrust bearings 300*a* and the second hydrostatic thrust bearing 300*b*, supplies pressurized fluid through the pressure regulators 400*a* and 400*b*. When the pressure regulators 400*a* and 400*b* have performed adjustment operations, their back pressures are changed. The difference in the pressure is used to precisely move the lower spindle 110 in the vertical direction. The second hydrostatic thrust bearings 300*a* and 300*b* and the hydrostatic radial bearings 600*a* and 600*b* are disposed on the outside of the lower spindle 110 to support the same. Their axes are in line with the axial line of the lower spindle 110.

The lower spindle 110 engaged in the inside portion of the lower housing 139 is rotated at high speed by the seventh motor 148 in the form of the built-in shape when the grinding operation is performed. Similarly to the upper-grinding wheel drive unit 107, the built-in type seventh motor 148 has a stator secured to the inner surface of the lower housing 139 and a rotor secured to the outer surface of the lower spindle 110. Thus, the axial line of the seventh motor 148 is made to be in line with the axial line of the lower spindle 110, that is the seventh motor 148 is coaxially disposed with the lower spindle 110.

Figure 17:
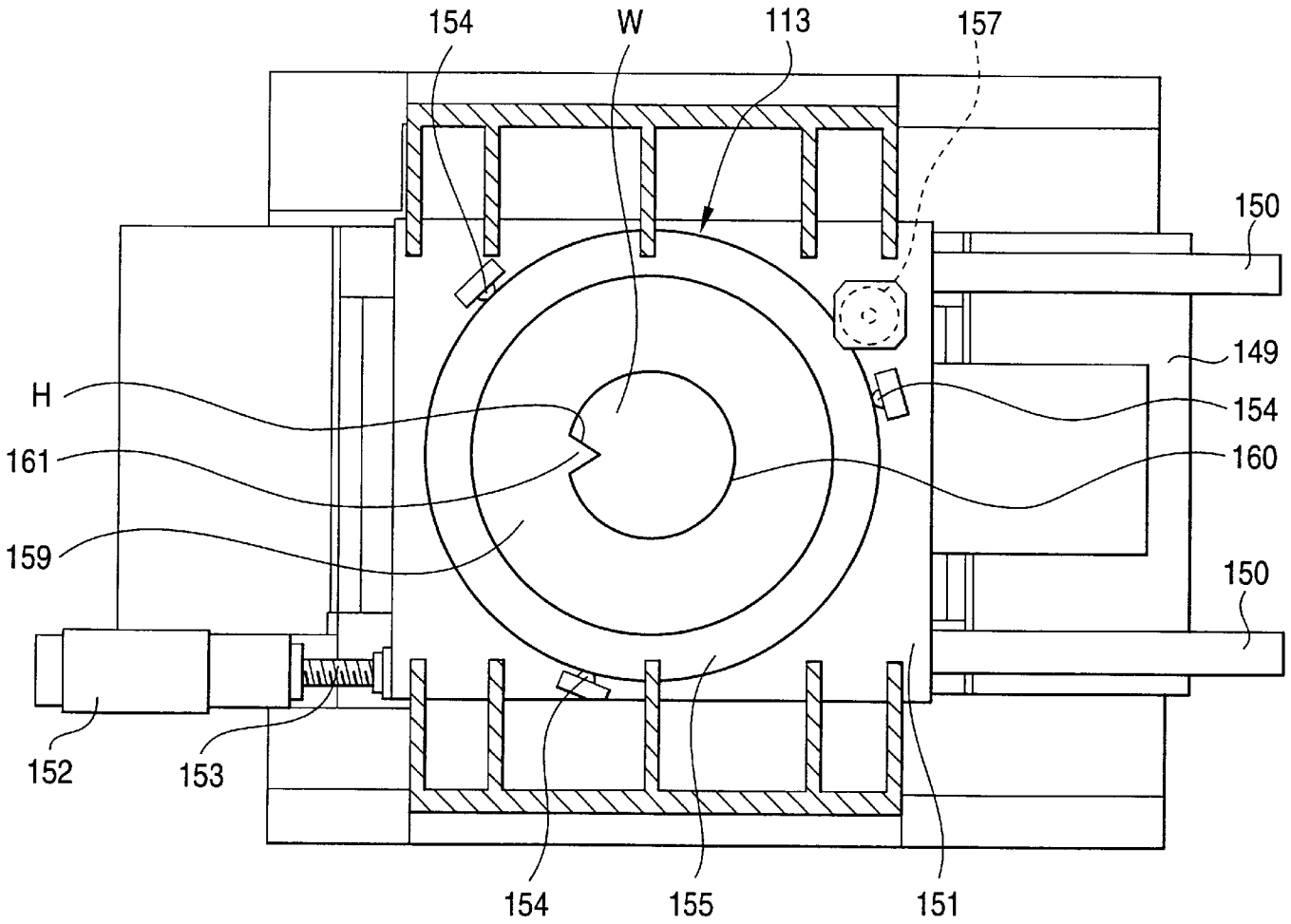
FIG. 17 is a plane view showing a work support unit.
Figure 18:
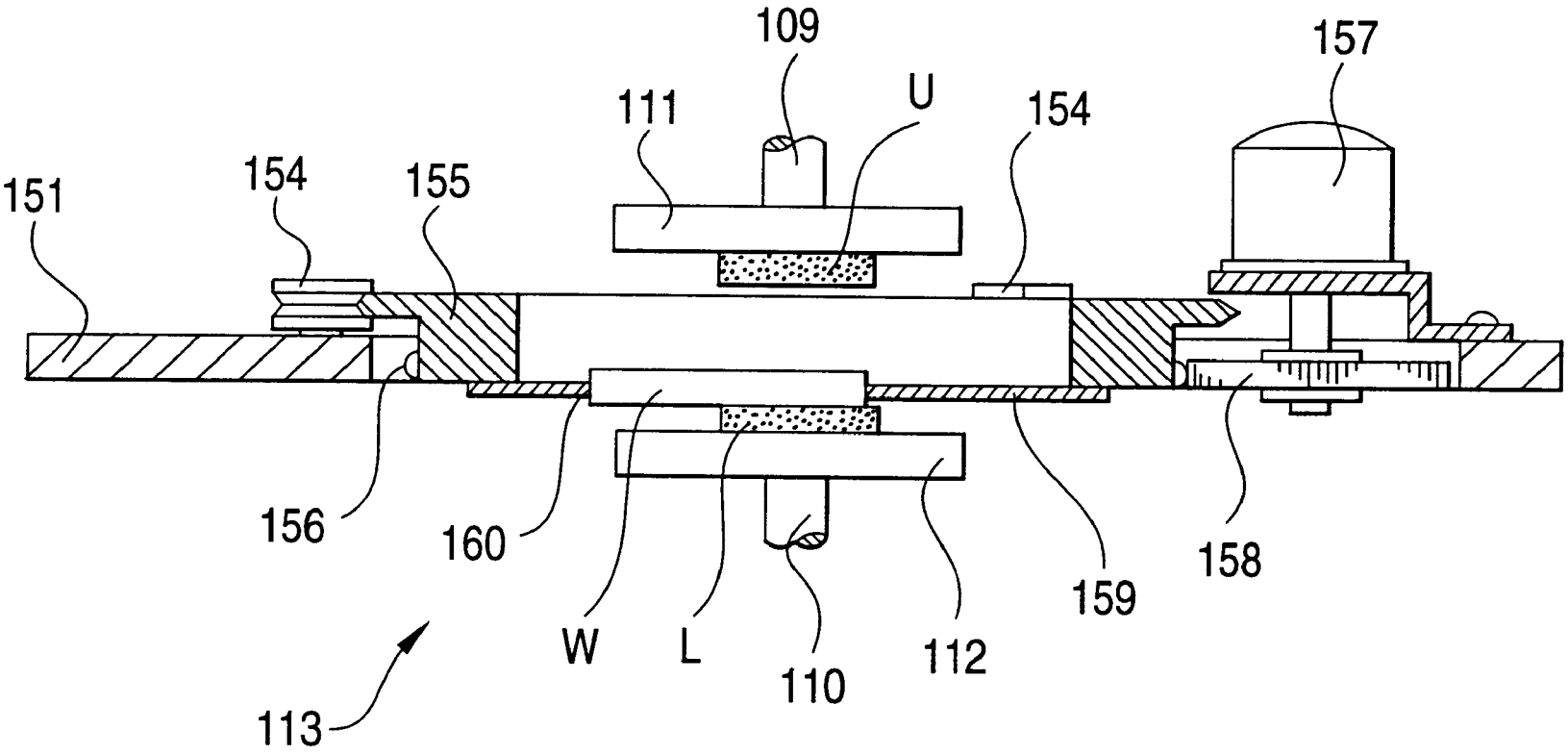
FIG. 18 is a cross sectional view showing an essential portion of the work support unit.

The work support unit 113 is disposed above the upper plate 104 of the bed 102, and the work support unit 113 is positioned upper than the lower grinding wheel L installed on the lower spindle 110. As shown in FIGS. 16 to 18, the work support unit 113 has a structure that a stationary table 149 is disposed on the upper plate 104 of the bed 102. Moreover, a horizontal guide 150 is secured above the stationary table 149 so as to be substantially in parallel to the stationary table 149 while being apart from the same for a predetermined distance. A sliding table 151, which is slidably moved on the upper surface of the horizontal guide 150 in the same direction as a direction in which the saddle 137 for supporting the lower-grinding wheel drive unit 108 is slidably moved, is moved by a fourth ball screw 153 which is rotated by an eighth motor 152 secured to the stationary table 149 as shown in FIG. 17. Note that the sliding table 151 is formed into a frame shape having a circular opening formed in a rectangular plate.

A plurality of guide rollers 154 each having a V-groove are disposed around the edge of the circular opening in the sliding table 151 at the same intervals in the circumferential direction of the circular opening. The guide rollers 154 rotatively support a rotational frame 155 in the form of an annular shape. As shown in FIG. 18, a follower gear 156 is formed on the outer surface of the rotational frame 155. A main drive gear 158 provided for a shaft of a ninth motor 157 provided for the sliding table 151 is engaged to the follower gear 156 so as to be rotated when the rotations of the ninth motor 157 have been started. Moreover, a support plate 159 is secured to the lower surface of the rotational frame 155 in such a manner that the internal space of the rotational frame 155 is covered. The support plate 159 is formed by a plate having a thickness smaller than that of the work W. The support plate 159 is arranged under a tension in the horizontally outward direction so that deflection and deformation of the support plate 159 because of the dead weight are prevented. Moreover, a setting hole 160 for detachably setting the work W to the central portion of the support plate 159 is formed. An engagement portion 161 in the form of a projection is formed at the inner end of the setting hole 160 so as to transmit the rotational force to the work W. On the other hand, the work W has an engagement portion H in the form of a recess which is so-called a "notch" arranged to be engaged to the engagement portion 161. The work W is received in the setting hole 160 from an upper position so as to be placed on the lower grinding wheel L mounted to the lower spindle 110. The work W sometimes has a cut portion (not shown) so-called an orientation flange. Also in this case, a means for transmitting the rotational force to the work W is similar to that employed when the notch is provided.

When the work W is set and the ninth motor 157 is rotated, the rotational frame 155 is therefore rotated by the main drive and follower gears 158 and 156. Thus, the work W set in the setting hole 160 of the support plate 159 provided for the rotational frame 155 is rotated in synchronization with the rotations of the rotational frame 155.

The structure is formed as described above. The work W is set to the lower grinding wheel B, and then the second motor 121 is quickly moved rotated so that the upper housing 115 is downwards. When the upper grinding wheel U has approached the upper surface of the work W, the first and seventh motors 117 and 148 which are built-in motors are rotated to rotate the upper and lower spindles 109 and 110. Thus, the downward moving speed of the upper housing 115 is considerably decelerated so that a suitable grinding operation is performed.

With this operation so far, since the upper housing 115 is rotatably supported by the first hydrostatic radial bearings 119*a* and 119*b* while the upper housing 115 is being disengaged with the upper guide 114, it is possible to grind the work precisely in order of sub-micron.

However, if it is required to grind the work more precisely, the rotations of the second motor 121 of the first feeding means 116 are interrupted. Moreover, the back pressure applied to the flange 128 of the lower hydrostatic thrust bearing 129*a* of the hydrostatic thrust bearings 129*a* and 129*b* is moderately reduced. Thus, the upper grinding wheel U is, in sub-micron units, moved downwards. As a result of the above-mentioned downward movement, significantly precise finishing is performed.

The structure in which the second lower feeding means is provided for the lower-grinding wheel drive unit 108 is arranged into a shape (not shown) similarly to the second upper feeding means 118. However, the structure is turned upside down. In this case, the work W is set to the work support unit 113, and then the upper grinding wheel U is moved downwards by the first feeding means 116 of the upper-grinding wheel drive unit 107. Thus, the work W is held between the upper and lower grinding wheels U and B, and then the upper and lower grinding wheels U and L and the work W are rotated. The lower grinding wheel L is slowly and upwards moved by the first lower feeding means 144 so that the grinding is performed precisely. Then, if required, the second lower feeding means is operated so that the precise grinding operation is performed. Thus, finishing or more precise grinding to realize a predetermined state is performed.

When the first and second feeding means 116, 118, 144 are provided for the upper- and lower-grinding wheel drive units 107 and 108, the two sides of the work W can simultaneously and precisely be finished by the upper and lower second feeding means.

In the above-mentioned description of the second embodiment according to the present invention, the twin-head grinder is explained. However, without saying that, the embodiment is applicable into a single-head grinder.

With the grinder according to the present invention comprising: a first grinding wheel drive unit stood erect in a vertical direction, said first grinding wheel drive unit including a first spindle rotatable and a first housing for rotatably supporting said first spindle; a first grinding wheel held at an end of said first spindle; a first feeding means for moving said first housing in the vertical direction, said first feeding means having a mechanism for converting rotational movement into linear movement; and a first hydrostatic radial bearing for movably supporting said first housing, it is possible to make a rigidity of the grinder increase and to grind the work precisely in order of sub-micron.

In addition, the grinder according to the present invention has the structure that switching is performed between the first feeding means which is capable of performing a quick feeding operation and the second feeding means which is capable of performing a precise feeding operation to grind a work. Since the feeding means suitable to fast feeding, feeding for the rough machining and feeding for the precise finishing can be selected, the work can significantly precisely be finished in shortest machining time.

The grinder according to the present invention has the structure that the axial line of the ball screw of the first feeding means is in line with the axial lines of the upper and lower spindles. Therefore, the grinding wheels can stably be fed.

The grinder according to the present invention comprises the second feeding means having the hydrostatic thrust bearings which support the spindles. The back pressure of the hydrostatic thrust bearing is changed so that the spindles are vertically moved. Therefore, the spindles can smoothly and precisely be moved in the vertical direction. As a result, significantly precise machining can be performed.

The grinder according to the present invention has the structure that all of the axial lines of the upper and lower spindles, the motors for rotating the upper and lower spindles and the first and second feeding means are made to be in line with one another. Therefore, a mechanically and thermally rigid structure can be realized. Moreover, a required amount of feeding can precisely be realized by the first and second feeding means. As a result, a work can reliably be finished to have a required thickness.

Further, the grinding method according to the present invention, it is possible to grind a work precisely by feeding a grinding wheel by a fine amount.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A grinder comprising:

a first grinding wheel drive unit (107) standing erect in a vertical direction, said first grinding wheel drive unit (107) including a first spindle (109) and a first housing (115) for rotatably supporting said first spindle;

a first grinding wheel (U) held at an end of said first spindle;

a first feeding means (116) for moving said first housing in the vertical direction, said first feeding means having a mechanism (121–126) for converting rotational movement into linear movement; and a first hydrostatic radial bearing (119) for movably supporting said first housing.

2. The grinder according to claim 1, wherein said first feeding means comprises a motor, a ball screw and a nut portion which are coupled with one another, and said ball screw is coaxially disposed with said first housing.

3. The grinder according to claim 1, in which said first grinding wheel drive unit comprises:

a second hydrostatic radial bearing (127) provided within said first housing for directly and rotatably supporting said first spindle; and a first hydrostatic thrust bearing for rotatably supporting said first spindle.

4. The grinder according to claim 3, further comprising:

a first supplemental feeding means for moving said first spindle in a vertical direction, said first supplemental feeding means having a first pressure regulating mechanism capable of regulating the pressure of a fluid in said first hydrostatic thrust bearing which rotatively supports said first spindle.

5. The grinder according to claim 1, wherein said first hydrostatic radial bearing (119) comprises a plurality hydrostatic radial bearing portions (119*a*, 119*b*) which are separated from each other in the vertical direction.

6. The grinder according to claim 1, further comprising:

a second grinding wheel drive unit (108) disposed opposite to said first grinding wheel drive unit and standing erect in a vertical direction, said second grinding wheel drive unit (108) including a second spindle (110) rotatable and a second housing (139) for rotatably supporting said second spindle;

a second grinding wheel (L) held at an end of said second spindle in a state in which said second grinding wheel is held in parallel substantially with and opposite to said first grinding wheel; and a second feeding means (144) for moving said second housing in the vertical direction, said second feeding means having a mechanism (145–147) for converting rotational movement into linear movement; and a third hydrostatic radial bearing (143) for movably supporting said second housing.

7. The grinder according to claim 6, wherein said second feeding means (144) has a motor (146), a ball screw (147) and a nut portion (145) which are coupled with one another, and said second housing is coaxially disposed with said ball screw.

8. The grinder according to claim 6, in which said second housing comprises:

a fourth hydrostatic radial bearing for rotatably supporting said second spindle; and a second hydrostatic thrust bearing for rotatably supporting said second spindle.

9. The grinder according to claim 8, further comprising:

a second supplemental feeding means for moving said second spindle in the vertical direction, said second supplemental feeding means having a second pressure regulating mechanism capable of regulating the pressure of a fluid in said second hydrostatic thrust bearing which rotatively supports said second spindle.

10. The grinder according to claim 6, wherein said third hydrostatic radial bearing (143) comprises a plurality of hydrostatic radial bearing portions (143*a*, 143*b*) which are separated from each other in the vertical direction.

11. A grinder comprising:

a first grinding wheel drive unit (30–33) standing erect in a vertical direction, and having a first spindle (23) rotatable and a first supporting member (22) for rotatably supporting said first spindle (23);

a first grinding wheel (28) held at an end of said first spindle;

a first feeding means (34–35) for moving said supporting member (22) in the vertical direction, said first feeding means having a mechanism (34–35) for converting rotational movement into linear movement;

a first hydrostatic thrust bearing (26, 27) for rotatively supporting said first spindle; and a second feeding means (36–39) for moving said first grinding wheel in a vertical direction, said second feeding means having a first pressure regulating mechanism capable of regulating the pressure of a fluid in said first hydrostatic thrust bearing.

12. The grinder according to claim 11, wherein the regulation of the pressure of the fluid in said first hydrostatic thrust bearing is performed by changing the back pressure of said hydrostatic thrust bearing.

13. The grinder according to claim 11, wherein said first pressure regulating mechanism comprises: a a fluid pressure generating device;

two fluid supply pipe passages for allowing said fluid pressure generating device to communicate with said first hydrostatic thrust bearing to supply the fluid therein;

a supply pressure regulating mechanism provided at least one of said two fluid supply pipe passages.

14. The grinder according to claim 13, wherein said supply pressure regulating mechanism has an apparatus for adjusting a restriction of the fluid.

15. The grinder according to claim 13, wherein said first spindle has a flange portion projecting radially, said first hydrostatic thrust bearing rotatably supports said flange portion, and an opening of one of said two fluid supply pipe passages faces the upper surface of said flange portion, and an opening of the other fluid supply pipe passage faces the lower surface of said flange portion.

16. The grinder according to claim 15, wherein each of said fluid supply pipe passages is respectively provided with an apparatus for adjusting a restriction of the fluid.

17. The grinder according to claim 11, further comprising:

a second grinding wheel drive unit (108) disposed opposite to said first grinding wheel drive unit (107) and standing erect in the vertical direction, said second grinding wheel drive unit (108) including a second spindle (110) rotatable and a second supporting member (139) for rotatably supporting said first spindle;

a second grinding wheel (B) held at an end of said second spindle in a state in which said second grinding wheel is held in parallel substantially with and opposite to said first grinding wheel; and third feeding means (144) for moving said second supporting member in the vertical direction, said third feeding means having a mechanism for converting rotational movement into linear movement.

18. The grinder according to claim 17, further comprising:

a second hydrostatic thrust bearing (300) for rotatively supporting said second spindle; and a fourth feeding means for moving said second spindle in the vertical direction, said fourth feeding means having a second pressure regulating mechanism which is capable of regulating the pressure of the fluid in said second hydrostatic thrust bearing.

19. The grinder according claim 18, wherein regulation of the pressure of the fluid in said first hydrostatic thrust bearing of said second feeding means is performed by changing the back pressure of said first hydrostatic thrust bearing, and regulation of the pressure of the fluid in said second hydrostatic thrust bearing of said fourth feeding means is performed by changing the back pressure of said second hydrostatic thrust bearing.

20. The grinder according to claim 18, wherein said first feeding means has a first motor, a first ball screw and a first nut portion, said third feeding means has a second motor, a second ball screw and a second nut portion, and the axial line of said first ball screw, the axial line of said first spindle, the axial line of said second ball screw, the axial line of said second spindle, the axial line of said first hydrostatic thrust bearing and the axial line of said second hydrostatic thrust bearing are in line with one another.

21. The grinder according to claim 18, wherein said first pressure regulating mechanism comprises a first fluid pressure generating device, two fluid supply pipe passages for allowing said first fluid pressure generating device to communicate with said first hydrostatic thrust bearing, and a first supply pressure regulating mechanism provided at least one of said two fluid supply passages, and said second pressure regulating mechanism comprises a second fluid pressure generating device, two fluid supply passages for allowing said second fluid pressure generating device to communicate with said second hydrostatic thrust bearing, and a second supply pressure regulating mechanism provided for at least one of said two fluid supply passages.

22. The grinder according to claim 21, wherein said first spindle has a first flange portion projecting radially at an end thereof, said first hydrostatic thrust bearing rotatively supports said first flange portion, an opening of one of said two fluid supply pipe passages faces the upper surface of said first flange portion, and an opening of the other fluid supply pipe passage adjacent to said first hydrostatic thrust bearing faces the lower surface of said first flange portion, said second spindle has a second flange portion projecting radially at an end thereof, said second hydrostatic thrust bearing rotatively supports said second flange portion, and an opening of one of said two fluid supply passages faces the upper surface of said second flange portion, and an opening of the other fluid supply passage faces the lower surface of said second flange portion.

23. The grinder according to claim 17, wherein said first grinding wheel drive unit has a first drive motor for rotating said first spindle, said second grinding wheel drive unit has a second drive motor for rotating said second spindle, said first feeding means has a first motor, a first ball screw and a first nut portion which are coupled with one another, said third feeding means has a second motor, a second ball screw and a second nut portion which are coupled with one another, and the rotational axis of said first drive motor, the rotational axis of said second drive motor, the axial line of said first ball screw, the axial line of said first spindle, the axial line of said second ball screw and the axial line of said second spindle are in line with one another.

24. The grinder according to claim 11, wherein said first grinding wheel drive unit has a drive motor for rotating said first spindle, said first feeding means has a motor, a ball screw and a nut portion which are coupled with one another, and the axial line of said ball screw, a rotational axis of said drive motor and the axial line of said first spindle are in line with one another.

25. A grinder comprising:

a first grinding wheel drive unit standing erect in a vertical direction, said first grinding wheel drive unit including a first spindle and a first housing for rotatably supporting said first spindle;

a first grinding wheel held at an end of said first spindle;

a first feeder which moves said first housing in the vertical direction, said first feeder converting rotational movement into linear movement of said first housing; and a first hydrostatic radial bearing for movably supporting said first housing.

26. A grinder comprising:

a first grinding wheel drive unit standing erect in a vertical direction, and having a first spindle and a first supporting member for rotatably supporting said first spindle;

a first grinding wheel held at an end of said first spindle;

a first feeder which moves said supporting member in the vertical direction, said first feeder converting rotational movement into linear movement of said supporting member;

a first hydrostatic thrust bearing for rotatively supporting said first spindle; and a second feeder which moves said first grinding wheel in a vertical direction, said second feeder having a first pressure regulating mechanism operative to regulate the pressure of a fluid in said first hydrostatic thrust bearing.

* * * * *